US009889695B2

(12) United States Patent
Kikuchi et al.

(10) Patent No.: US 9,889,695 B2
(45) Date of Patent: Feb. 13, 2018

(54) IMAGE RECORDING METHOD

(71) Applicant: FUJIFILM Corporation, Tokyo (JP)

(72) Inventors: Wataru Kikuchi, Kanagawa (JP); Yuji Yoshida, Kanagawa (JP); Seiya Sakurai, Kanagawa (JP); Ryuji Shinohara, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/460,470

(22) Filed: Mar. 16, 2017

(65) Prior Publication Data

US 2017/0182828 A1 Jun. 29, 2017

Related U.S. Application Data

(63) Continuation of application No. PCT/JP2015/075767, filed on Sep. 10, 2015.

(30) Foreign Application Priority Data

Sep. 30, 2014 (JP) ..... 2014-201708

(51) Int. Cl.
*B41M 5/52* (2006.01)

(52) U.S. Cl.
CPC ..... *B41M 5/52* (2013.01)

(58) Field of Classification Search
None
See application file for complete search history.

(56) References Cited

FOREIGN PATENT DOCUMENTS

| | | | | |
|---|---|---|---|---|
| EP | 0 888 902 A1 | | 1/1999 | |
| JP | 57191084 A | * | 11/1982 | ..... B41M 5/52 |
| JP | 11-028417 A | | 2/1999 | |
| JP | 2009-226598 A | | 10/2009 | |
| JP | 2010-023339 A | | 2/2010 | |

OTHER PUBLICATIONS

International Preliminary Report on Patentability and Written Opinion, dated Apr. 4, 2017, in corresponding International Application No. PCT/JP2015/075767, 8 pages in English and Japanese.
International Search Report of PCT/JP2015/075767, dated Nov. 24, 2015. [PCT/ISA/210].
Communication dated Oct. 18, 2017, from European Patent Office in counterpart application No. 15846746.4.

* cited by examiner

*Primary Examiner* — Lisa M Solomon
(74) *Attorney, Agent, or Firm* — Sughrue Mion, PLLC

(57) ABSTRACT

The image recording method includes the following steps (a) to (c):

(a) forming a barrier layer on a recording medium by using a solution which contains an acidic group-containing polymer in a nonaqueous medium;
(b) forming an organic acid-containing layer on the barrier layer; and
(c) forming an image by jetting an aqueous ink onto the organic acid-containing layer by an ink jet method.

12 Claims, No Drawings

IMAGE RECORDING METHOD

CROSS-REFERENCE TO RELATED APPLICATIONS

This application is a Continuation of PCT International Application No. PCT/JP2015/75767, filed on Sep. 10, 2015, which claims priority under 35 U.S.C. § 119(a) to Japanese Patent Application No. 2014-201708, filed on Sep. 30, 2014. Each of the above application(s) is hereby expressly incorporated by reference, in its entirety, into the present application.

BACKGROUND OF THE INVENTION

1. Field of the Invention

The present invention relates to an image recording method.

2. Description of the Related Art

As image recording methods for forming an image on a recording medium such as paper based on an image data signal, there are recording methods such as an electrophotographic method, sublimation-type and melting-type thermal transfer methods, and an ink jet method.

In the ink jet recording method, a printing plate is not required, and an image is directly formed on a recording medium by jetting an ink only to an image forming portion. Therefore, in this method, the ink can be efficiently used, and the running cost is low. Furthermore, a printing device used in the ink jet recording method is relatively cheaper than a printer used in the related art, can be downsized, and causes little noise. In this way, the ink jet recording method has various advantageous compared to other image recording methods.

When an image is recorded on a recording medium by the ink jet recording method, the water in an aqueous ink cleaves hydrogen bonds of cellulose in paper as a recording medium, the cleaved hydrogen bonds are recombined after drying, and this leads to a phenomenon (curling or cockling) in which the recording medium is deformed.

In order to prevent the deformation of the recording medium, a method of adding an anti-curl agent such as a saccharide to an ink, a method of forcibly preventing the curling or cockling by using a paper pressing mechanism of a transport portion, and the like have been suggested. However, none of these methods has succeeded in sufficiently preventing the deformation of the recording medium.

Furthermore, a technique is also examined in which a layer (barrier layer) for preventing the permeation of an aqueous ink is formed on a recording medium so as to prevent the aqueous ink from permeating the inside of the recording medium and to prevent the curling or cockling of the recording medium on which an image has been formed.

For example, JP1999-28417A (JP-H11-28417A) describes an ink jet recording medium in which an ink adsorbing coating film containing a specific polymer compound and a hydroxy group-containing polymer compound is on the surface of a substrate. JP1999-28417A (JP-H11-28417A) describes that, when the recording medium is used for ink jet recording, the occurrence of curling is inhibited.

JP2010-23339A describes that, by treating a recording medium with an aqueous treatment solution containing a water-soluble polymer before recording an image by an ink jet, the occurrence of bleeding of the image or color mixing is inhibited, and the occurrence of curling or cockling of the recording medium is also inhibited.

JP2009-226598A describes that, by forming a blocking layer containing resin particles having an SP value of equal to or greater than 9.5 on a recording medium, the occurrence of curling of the recording medium on which an image has been formed is inhibited.

SUMMARY OF THE INVENTION

However, in a case where the layer containing a polymer compound described in JP1999-28417A (JP-H11-28417A) is provided on a recording medium, unfortunately, a degree of glossiness of the image formed thereon increases, and hence an image having natural color shades is not easily formed.

In a case where a recording medium is treated with an aqueous treatment solution containing a water-soluble polymer as described in JP2010-23339A, the recording medium swells due to the moisture in the treatment solution, and hence the deformation of the recording medium is not reliably inhibited.

In a case where a blocking layer is formed using resin fine particles as described in JP2009-226598A, water may permeate the recording medium from a void between the resin fine particles, and hence the recording medium is likely to be deformed.

Generally, a barrier layer changes the properties of a surface of a recording medium. Therefore, for example, in a case where an ink is jetted onto the recording medium having a barrier layer by an ink jet method, unfortunately, a dot diameter changes further than in a case where the ink is jetted onto a recording medium without a barrier layer. That is, unfortunately, the image quality of the recording medium originally has deteriorates due to the barrier layer provided.

An object of the present invention is an image recording method which includes jetting of an aqueous ink on a recording medium including a barrier layer by an ink jet method, effectively inhibits the deformation of the recording medium on which an image has been formed, and inhibits both of a change of a dot diameter and an increase of a degree of glossiness that are caused by an influence of a barrier layer.

In order to achieve the aforementioned object, the inventors of the present invention repeated intensive investigation. As a result, they obtained knowledge that, by forming a barrier layer on a recording medium by using a solution, which is obtained by dissolving an acidic group-containing polymer in a nonaqueous medium, and providing an organic acid-containing layer on the barrier layer, it is possible to greatly inhibit the occurrence of cockling of the recording medium when an image is formed by jetting an aqueous ink by an ink jet method, to inhibit both of a change of a dot diameter and an increase of a degree of glossiness of the image that are caused by an influence of the barrier layer, and to form an image with excellent quality.

Based on the knowledge, the inventors further repeated investigation and accomplished the present invention.

The aforementioned objects of the present invention were achieved by the following means.

[1] An image recording method comprising the following steps (a) to (c):

(a) forming a barrier layer on a recording medium by using a solution which is obtained by dissolving an acidic group-containing polymer in a nonaqueous medium;

(b) forming an organic acid-containing layer on the barrier layer; and (c) forming an image by jetting an aqueous ink onto the organic acid-containing layer by an ink jet method.

[2] The image recording method according to [1], in which the acidic group-containing polymer consists of a constitutional unit represented by the following Formula (1) and a constitutional unit represented by the following Formula (2).

Formula (1)

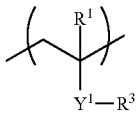

Formula (2)

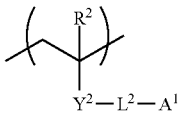

In the formulae, $R^1$ and $R^2$ represent a hydrogen atom or methyl. $Y^1$ and $Y^2$ represent —C(=O)O—, —C(=O)$NR^Y$—, or a phenylene group. $R^Y$ represents a hydrogen atom or an alkyl group. $R^3$ represents a hydrogen atom, an alkyl group, or an aromatic group. $L^2$ represents a single bond or a divalent linking group. $A^1$ is a hydrogen atom or an acidic group. In a case where $A^1$ is a hydrogen atom, —$Y^2$-$L^2$-$A^1$ is a carboxy group.

[3] The image recording method according to [2], in which in the acidic group-containing polymer, a content rate of the constitutional unit represented by Formula (1) is 70% to 99% by mass, and a content rate of the constitutional unit represented by Formula (2) is 1% to 30% by mass.

[4] The image recording method according to any one of [1] to [3], in which the acidic group is at least one of group selected from —COOH, —$SO_3H$, —OP(=O)$(OH)_2$, and —P(=O)$(OH)_2$.

[5] The image recording method according to [4], in which the acidic group is at least one of group selected from —OP(=O)$(OH)_2$, and —P(=O)$(OH)_2$.

[6] The image recording method according to any one of [1] to [5], in which an acid value of the acidic group-containing polymer is equal to or less than 200 mgKOH/g.

[7] The image recording method according to any one of [1] to [6], in which a weight-average molecular weight of the acidic group-containing polymer is less than 20,000.

[8] The image recording method according to any one of [1] to [7], in which the organic acid is at least one selected from the group consisting of DL-malic acid, malonic acid, glutaric acid, maleic acid, and a phosphoric acid compound.

[9] The image recording method according to any one of [1] to [8], in which an amount of the acidic group-containing polymer in the barrier layer is less than 10 $g/m^2$.

[10] The image recording method according to any one of [1] to [9], in which the recording medium is a paper medium.

[11] The image recording method according to [10], in which the paper medium has a coating layer containing calcium carbonate.

[12] The image recording method according to any one of [1] to [11], in which the step (c) includes fixing the image by heating.

In the present specification, unless otherwise specified, when there is a plurality of substituents, linking groups, ligands, repeating units, and the like (hereinafter, referred to as substituents and the like) represented by specific references or when a plurality of substituents and the like are collectively or selectively specified, each of the substituents and the like may be the same as or different from each other. The same shall be applied when the number of substituents and the like is specified.

In the present specification, the term "group" of each group described as an example of each substituent means both of an unsubstituted group and a group having a substituent. For example, an "alkyl group" means an alkyl group which may have a substituent.

In the present specification, when the term "compound" is added to the end of a word or when the compound is described using a chemical formula or a specific name, unless otherwise specified, the term means a salt, a complex, and an ion of the compound in addition to the compound itself.

In the present specification, "(meth)acrylate" means both of acrylate and methacrylate. The same shall be applied to "(meth)acrylic acid".

In the present specification, a range of numerical values represented using "to" means a range which includes the numerical values listed before and after "to" as a lower limit and an upper limit.

According to the image recording method of the present invention, the deformation of a recording medium on which an image has been formed can be effectively inhibited. Furthermore, a change of a dot diameter that is caused by an influence of a barrier layer is reduced, and an increase of a degree of glossiness that is caused by an influence of a barrier layer is inhibited.

DESCRIPTION OF THE PREFERRED EMBODIMENTS

The image recording method of the present invention includes the following steps (a) to (c).

(a) forming a barrier layer on a recording medium by using a solution containing an acidic group-containing polymer in a nonaqueous medium (preferably obtained by dissolving an acidic group-containing polymer an a nonaqueous medium)

(b) forming an organic acid-containing layer on the barrier layer (c) forming an image by jetting an aqueous ink onto the organic acid-containing layer by an ink jet method Preferred embodiments of the image recording method of the present invention will be described below.

[Step (a) (Barrier Layer Forming Step)]

In the step (a), by using a solution containing an acidic group-containing polymer in a nonaqueous medium (preferably obtained by dissolving an acidic group-containing polymer in a nonaqueous medium), a barrier layer is formed on a recording medium. Generally, by coating the recording medium with the solution obtained by dissolving the acidic group-containing polymer in the nonaqueous medium and drying the solution, a barrier layer containing the acidic group-containing polymer is formed on the recording medium.

The barrier layer plays a role of inhibiting the moisture in an aqueous ink from permeating the inside of the recording medium.

<Nonaqueous Medium>

The nonaqueous medium dissolving the acidic group-containing polymer means an organic solvent having a moisture content of less than 1% by mass, and preferably means an organic solvent having a moisture content of less than 0.5% by mass. The moisture content of the nonaqueous medium is generally equal to or greater than 0.01% by mass although the moisture content may be preferably 0%. By dissolving the acidic group-containing polymer in the nonaqueous medium and forming a barrier layer by using the solution, it is possible to form a barrier layer with preventing moisture from permeating the recording medium and to inhibit the deformation of the recording medium. The nonaqueous medium is appropriately selected from the viewpoint of a boiling point suitable for the coating and drying step and in consideration of the solubility of the polymer.

The nonaqueous medium is not particularly limited as long as it is an organic solvent having a moisture content of less than 1% by mass, and examples thereof include an ethylene glycol monoalkyl ether compound, an ethylene glycol dialkyl ether compound, an ethylene glycol monoalkyl ether acetate compound, a propylene glycol monoalkyl ether compound, a propylene glycol dialkyl ether compound, a propylene glycol monoalkyl ether acetate compound, a diethylene glycol dialkyl ether compound, a diethylene glycol monoalkyl ether acetate compound, a dipropylene glycol monoalkyl ether compound, a dipropylene glycol dialkyl ether compound, a dipropylene glycol monoalkyl ether acetate compound, an ester compound, a ketone compound, an amide compound, an alcohol compound, and a lactone compound.

Specific examples of the ethylene glycol monoalkyl ether compound include ethylene glycol monomethyl ether, ethylene glycol monoethyl ether, ethylene glycol monopropyl ether, and ethylene glycol monobutyl ether.

Specific examples of the ethylene glycol dialkyl ether compound include ethylene glycol dimethyl ether, ethylene glycol diethyl ether, and ethylene glycol dipropyl ether.

Specific examples of the ethylene glycol monoalkyl ether acetate compound include ethylene glycol monomethyl ether acetate, ethylene glycol monoethyl ether acetate, ethylene glycol monopropyl ether acetate, and ethylene glycol monobutyl ether acetate.

Specific examples of the propylene glycol monoalkyl ether compound include propylene glycol moonmethyl ether, propylene glycol monoethyl ether, propylene glycol monopropyl ether, and propylene glycol monobutyl ether.

Specific examples of the propylene glycol dialkyl ether compound include propylene glycol dimethyl ether and propylene glycol diethyl ether.

Specific examples of the propylene glycol monoalkyl ether acetate compound include propylene glycol monomethyl ether acetate, propylene glycol monoethyl ether acetate, propylene glycol monopropyl ether acetate, and propylene glycol monobutyl ether acetate.

Specific examples of the diethylene glycol dialkyl ether compound include diethylene glycol dimethyl ether, diethylene glycol diethyl ether, and diethylene glycol ethyl methyl ether.

Specific examples of the diethylene glycol monoalkyl ether acetate compound include diethylene glycol monomethyl ether acetate, diethylene glycol monoethyl ether acetate, diethylene glycol monopropyl ether acetate, and diethylene glycol monobutyl ether acetate.

Specific examples of the dipropylene glycol monoalkyl ether compound include dipropylene glycol monomethyl ether, dipropylene glycol monoethyl ether, dipropylene glycol monopropyl ether, and dipropylene glycol monobutyl ether.

Specific examples of the dipropylene glycol dialkyl ether compound include dipropylene glycol dimethyl ether, dipropylene glycol diethyl ether, and dipropylene glycol ethyl methyl ether.

Specific examples of the dipropylene glycol monoalkyl ether acetate compound include dipropylene glycol monomethyl ether acetate, dipropylene glycol monoethyl ether acetate, dipropylene glycol monopropyl ether acetate, and dipropylene glycol monobutyl ether acetate.

Specific examples of the ester compound include a lactic acid ester such as methyl lactate, ethyl lactate, n-propyl lactate, isopropyl lactate, n-butyl lactate, isobutyl lactate, n-amyl lactate, and isoamyl lactate; an aliphatic carboxylic acid ester such as n-butyl acetate, isobutyl acetate, n-amyl acetate, isoamyl acetate, n-hexyl acetate, 2-ethylhexyl acetate, ethyl propionate, n-propyl propionate, isopropyl propionate, n-butyl propionate, isobutyl propionate, methyl butyrate, ethyl butyrate, n-propyl butyrate, isopropyl butyrate, n-butyl butyrate, and isobutyl butyrate; hydroxyethyl acetate, ethyl 2-hydroxy-2-methylpropionate, ethyl 2-hydroxy-3-methylbutyrate, methoxyethyl acetate, ethoxyethyl acetate, methyl 3-methoxypropionate, ethyl 3-methoxypropionate, methyl 3-ethoxypropionate, ethyl 3-ethoxypropionate, 3-methoxybutyl acetate, 3-methyl-3-methoxybutyl acetate, 3-methyl-3-methoxybutyl propionate, 3-methyl-3-methoxybutyl butyrate, methyl acetoacetate, ethyl acetoacetate, methyl pyruvate, and ethyl pyruvate.

Specific examples of the ketone compound include methyl ethyl ketone, methyl propyl ketone, methyl-n-butyl ketone, methyl isobutyl ketone, 2-heptanone, 3-heptanone, 4-heptanone, cyclohexanone, and acetone.

Specific examples of the amide compound include formamide, N,N-dimethylformamide, N,N-dimethylacetamide, methoxypropionamide, N-methylmethoxypropionamide, N,N-dimethylmethoxypropionamide, n-butoxypropionamide, N-methyl n-butoxypropionamide, and N,N-dimethyl n-butoxypropionamide.

Specific examples of the alcohol compound include methanol, ethanol, propanol, isopropanol, butanol, isobutanol, sec-butanol, tert-butanol, pentanol, hexanol, cyclohexanol, benzyl alcohol, ethylene glycol, diethylene glycol, triethylene glycol, polyethylene glycol, propylene glycol, dipropylene glycol, polypropylene glycol, butylene glycol, hexanediol, pentanediol, glycerin, hexanetriol, thiodiglycol, and 2-methylpropanediol.

Furthermore, it is possible to use 2-pyrrolidone, N-methyl-2-pyrrolidone, cyclohexyl pyrrolidone, 2-oxazolidone, 1,3-dimethyl-2-imidazolidinone, γ-butyrolactone, propylene carbonate, ethylene carbonate, ethylene urea, dimethyl sulfoxide, sulfolane, acetonitrile, and the like.

Among the aforementioned nonaqueous media, a medium selected from the ethylene glycol monoalkyl ether compound, the ketone compound, and the alcohol compound is preferably used, and a medium selected from methyl ethyl ketone and propanol is more preferably used.

In the present invention, as the nonaqueous medium, one kind of the nonaqueous medium described above may be used singly, or two or more kinds thereof may be used by being mixed together.

<Acidic Group-Containing Polymer>

In the present specification, an acidic group means a substituent having a dissociable proton. The acidic group may be a substituent from which the proton is released and dissociated or may be a salt.

The acidic group-containing polymer preferably has, as a preferred acidic group, at least one of group selected from —COOH, $—SO_3H$, $—OP(=O)(OH)_2$, and $—P(=O)(OH)_2$. Particularly, the acidic group-containing polymer preferably has at least one of group selected from $—OP(=O)(OH)_2$ and $—P(=O)(OH)_2$ as an acidic group, and more preferably has $—OP(=O)(OH)_2$ as a preferred acidic group.

The acidic group-containing polymer is not particularly limited. From the viewpoint of the viscosity of the polymer solution and the degree of glossiness, an acid value of the acidic group-containing polymer is preferably equal to or less than 200 mgKOH/g, and more preferably equal to or less than 170 mgKOH/g. From the viewpoint of wettability, the acid value of the acidic group-containing polymer is preferably equal to or greater than 15 mgKOH/g, and more preferably equal to or greater than 20 mgKOH/g. The acid value is measured based on JIS K0070.

A weight-average molecular weight of the acidic group-containing polymer is preferably 4,000 to 20,000, more preferably less than 20,000, and even more preferably 13,000 to 19,000. In a case where the weight-average molecular weight of the acidic group-containing polymer is within the aforementioned preferred range, it is possible to inhibit a change of a degree of glossiness that is caused by an influence of the barrier layer and to effectively bring about barrier properties against water.

In the present specification, the weight-average molecular weight is measured by gel permeation chromatography (GPC). For GPC, HLC-8220GPC (manufactured by Tosoh Corporation, 4.6 mmID×15 cm) is used, three columns of TSKgel Super HZM-H, TSKgel Super HZ4000, and TSKgel Super HZ2000 (manufactured by Tosoh Corporation) are connected in series, and tetrahydrofuran (THF) is used as an eluant. In addition, GPC is performed using an IR detector under conditions of a sample concentration of 0.35% by mass, a flow rate of 0.35 ml/min, a sample injection amount of 10 μl, and a measurement temperature of 40° C. In addition, a calibration curve is prepared from six samples of "standard sample TSK standard, polystyrene" manufactured by Tosoh Corporation: "F-80", "F-20", "F-4", F-2", A-5000", and "A-1000".

Because the polymer forming the barrier layer contains an acidic group, it is possible to effectively inhibit the cockling of the recording medium. It is unclear what brings about such an effect. However, presumably, one of the reasons is that the acidic group of the polymer may accelerate the aggregation of the components contained in the aqueous ink.

In addition, because the polymer forming the barrier layer contains an acidic group, the organic acid-containing solution, which will be described later, does not easily bounce off the barrier layer, and hence a uniform aggregation-inducing layer can be provided on the barrier layer.

The acidic group-containing polymer is more preferably a polymer (preferably a random polymer) consists of a constitutional unit represented by the following Formula (1) and a constitutional unit represented by the following Formula (2). The acidic group-containing polymer may contain one kind of the constitutional unit represented by the following Formula (1) or two or more kinds thereof. Furthermore, the acidic group-containing polymer may contain one kind of the constitutional unit represented by the following Formula (2) or two or more kinds thereof Formula (1)

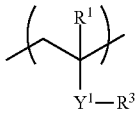

Formula (2)

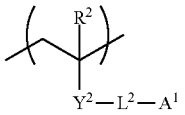

In the formulae, $R^1$ and $R^2$ represent a hydrogen atom or a methyl group, and more preferably represent a methyl group.

$Y^1$ and $Y^2$ represent —C(=O)O—, —C(=O)$NR^Y$—, or a phenylene group, and more preferably represent —C(=O)O—. $R^Y$ represents a hydrogen atom or an alkyl group (preferably an alkyl group having 1 to 10 carbon atoms, more preferably an alkyl group having 1 to 6 carbon atoms, even more preferably an alkyl group having 1 to 3 carbon atoms, and still more preferably a methyl group or an ethyl group). $R^Y$ more preferably represents a hydrogen atom.

$R^3$ represents a hydrogen atom, an alkyl group, or an aromatic group, and more preferably represents an alkyl group.

Examples of the alkyl group adopted as $R^3$ include a linear, branched, or cyclic alkyl group having 1 to 20 carbon atoms. Specific examples of such an alkyl group include a methyl group, an ethyl group, a propyl group, a butyl group, a pentyl group, a hexyl group, a heptyl group, an octyl group, a nonyl group, a decyl group, an undecyl group, a dodecyl group, a tridecyl group, a hexadecyl group, an octadecyl group, an eicosyl group, an isopropyl group, an isobutyl group, a s-butyl group, a t-butyl group, an isopentyl group, a neopentyl group, a 1-methylbutyl group, an isohexyl group, a 2-ethylhexyl group, a 2-methylhexyl group, a cyclohexyl group, a cyclopentyl group, and a 2-norbornyl group. Among these alkyl groups, a linear alkyl group having 1 to 18 carbon atoms, a branched alkyl group having 3 to 12 carbon atoms, or a cyclic alkyl group having 5 to 10 carbon atoms is preferable, a linear alkyl group having 1 to 12 carbon atoms is more preferable, and a methyl group or an ethyl group is even more preferable.

The aromatic group which can be adopted as $R^3$ refers to a group exhibiting aromaticity and includes an aryl group and a heteroaryl group.

In a case where $R^3$ is an aryl group, an aryl group having 6 to 20 carbon atoms is preferable, and an aryl group having 6 to 12 carbon atoms is more preferable. In a case where $R^3$ is an aryl group, specific examples thereof preferably include a phenyl group or a naphthyl group. Among these, a phenyl group is preferable.

In a case where $R^3$ is a heteroaryl group, examples thereof include an imidazolyl group, a pyridyl group, a quinolyl group, a furyl group, a thienyl group, a benzoxazolyl group, an indolyl group, a benzimidazolyl group, a benzothiazolyl group, a carbazolyl group, and an azepinyl group.

$L^2$ represents a single bond or a divalent linking group.

In a case where $L^2$ is a divalent linking group, an alkylene group is preferable. In a case where $L^2$ is an alkylene group, an alkylene group having 1 to 10 carbon atoms is preferable, an alkylene group having 1 to 8 carbon atoms is more preferable, an alkylene group having 1 to 6 carbon atoms is even more preferable, and an alkylene group having 2 to 4 carbon atoms is still more preferable. The alkylene group may be linear or branched.

In the present specification, the "alkylene group" means not only an aspect of —$C_mH_{2m}$— (m represents an integer of equal to or greater than 1) but also an alkylene group in which some of carbon atoms constituting the alkylene group are substituted with a heteroatom (preferably an oxygen atom or a sulfur atom, and more preferably an oxygen atom) and an alkylene group in which either or both of an ester bond and an arylene group (preferably a phenylene group) are incorporated into the carbon chain of the alkylene group.

In a case where $L^2$ is a divalent linking group, the divalent linking group is preferably —$C_mH_{2m}$— or —$[(CH_2)_nO]_p$—. Herein, m represents an integer of 1 to 10, preferably represents an integer of 2 to 6, and even more preferably represents an integer of 2 to 4. n represents an integer of 1 to 5, preferably represents 2 or 3, and even more preferably represents 2. p is an integer of 1 to 10, preferably represents an integer of 2 to 5, and even more preferably represents 3 or 4.

$A^1$ is a hydrogen atom or an acidic group. In a case where $A^1$ is a hydrogen atom, —$Y^2$-$L^2$-$A^1$ is a carboxy group. In a case where $A^1$ is an acidic group, $L^2$ is preferably a divalent linking group.

The acidic group which can be adopted as $A^1$ is preferably —COOH (carboxy group), —$SO_3H$ (sulfo group), or —OP(=O)$(OH)_2$. From the viewpoint of effectively inhibiting the occurrence of cockling, $A^1$ is more preferably —OP(=O)$(OH)_2$. In a case where $A^1$ is —OP(=O)$(OH)_2$, $L^2$ is preferably the aforementioned —$C_mH_{2m}$— or —$[(CH_2)_nO]_p$—.

In a case where the acidic group-containing polymer used in the present invention is constituted with a constitutional unit represented by Formula (1) and a constitutional unit represented by Formula (2), in the acidic group-containing polymer, a content rate of the constitutional unit represented by Formula (1) and a content rate of the constitutional unit represented by Formula (2) are preferably 70% to 99% by mass and 1% to 30% by mass respectively, more preferably 75% to 98% by mass and 2% to 25% by mass respectively, even more preferably 80% to 96% by mass and 4% to 20% by mass respectively, and particularly preferably 82% to 94% by mass and 6% to 18% by mass respectively.

Specific examples of preferred acidic group-containing polymer which can be used in the present invention will be shown below, but the present invention is not limited thereto. In the following structural formulae, the value of the number of constitutional units simply shows a mass ratio and does not signifies that the polymer is in the form of a block copolymer. In the present specification, "*" in a structural formula shows a linking site.

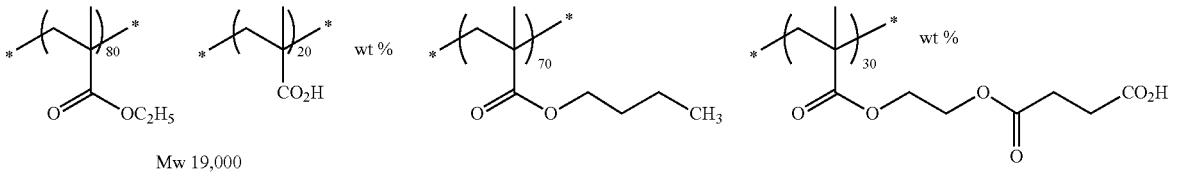

Mw 19,000

Mw 13,000

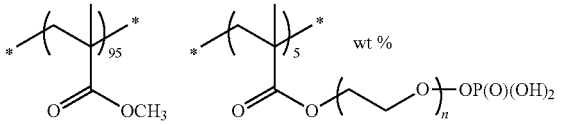

n = 3 - 4

Mw 14,000

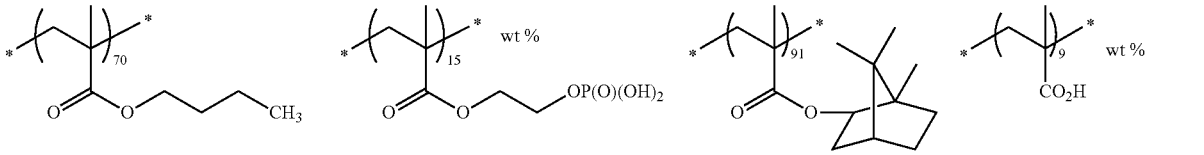

Mw 19,000

Mw 9,000

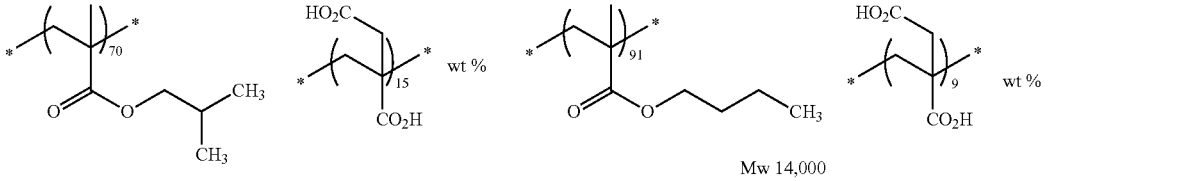

Mw 8,000

Mw 14,000

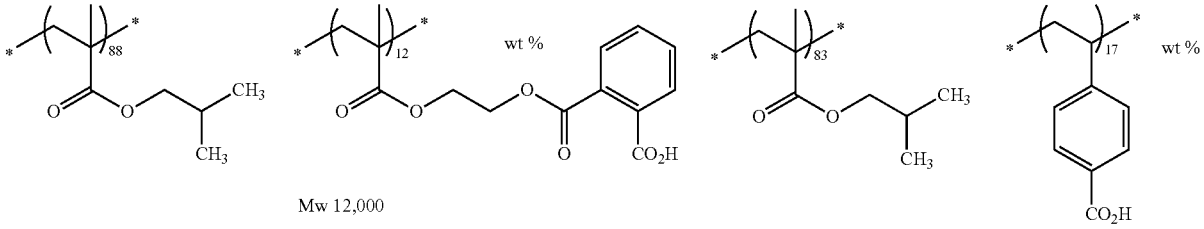

Mw 12,000

Mw 13,000

-continued
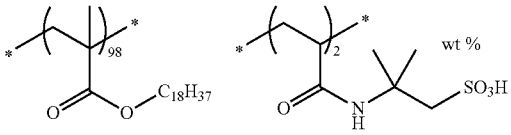
Mw 14,000
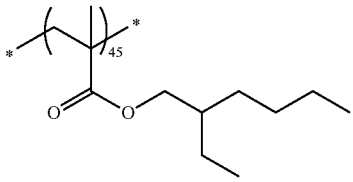
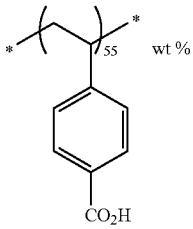
Mw 18,000
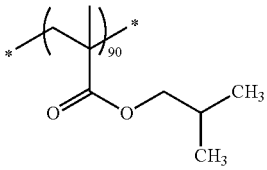
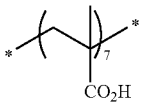
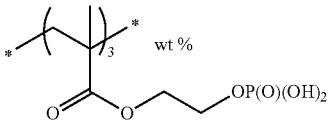
Mw 17,000
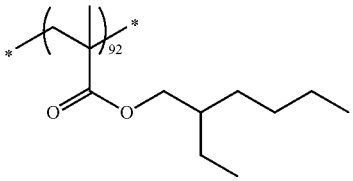
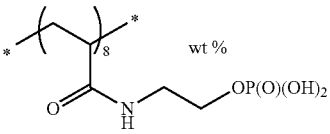
Mw 32,000
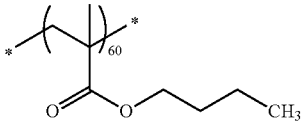
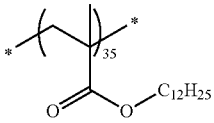
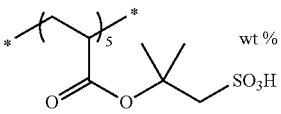
Mw 13,000
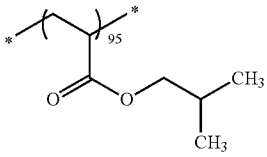
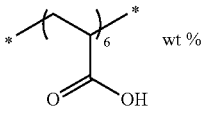
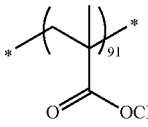
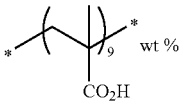
Mw 13,000
Mw 9,000
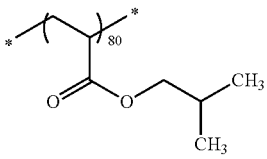
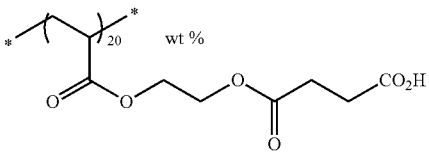
Mw 17000
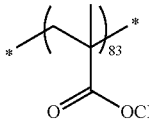
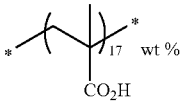
Mw 14,000
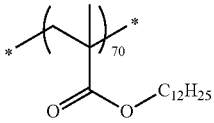
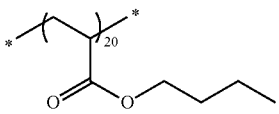
Mw 12,000
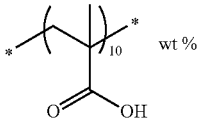
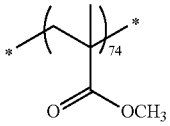
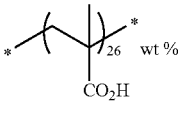
Mw 15,000
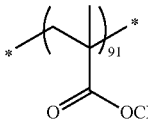
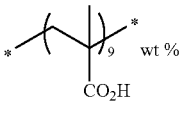
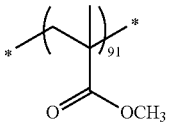
Mw 4,000
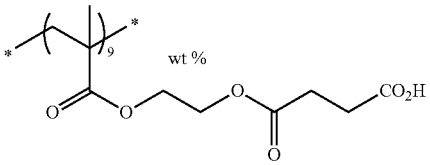
Mw 13,000

-continued
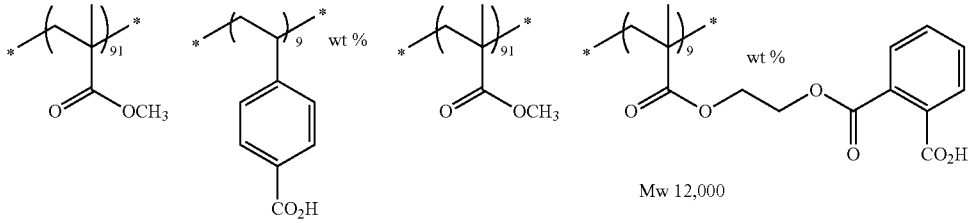
Mw 9,000 Mw 12,000
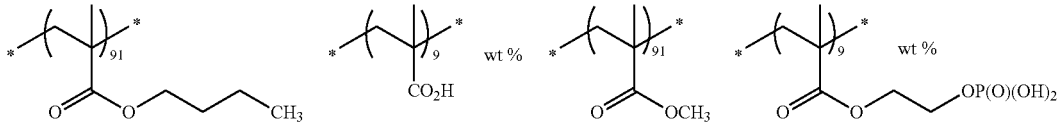
Mw 9,000 Mw 18,000
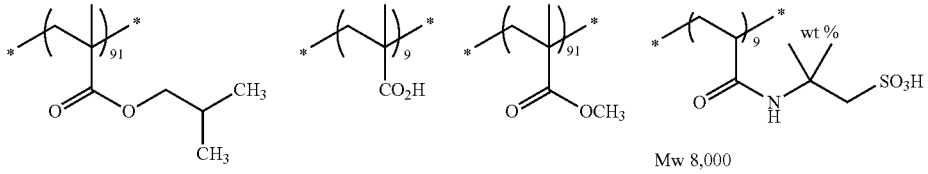
Mw 9,000 Mw 8,000
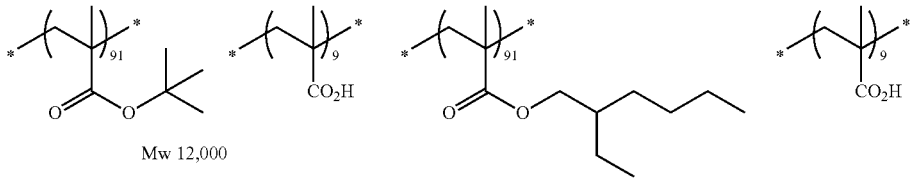
Mw 12,000 Mw 12,000
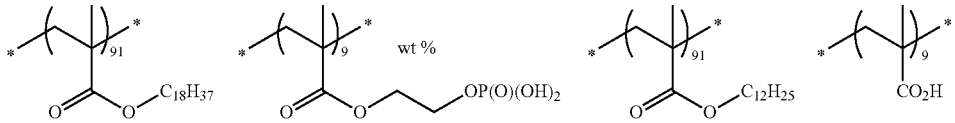
Mw 13,000 Mw 18,000
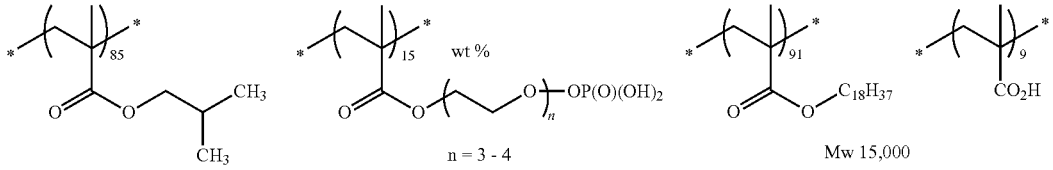
Mw 16,000 n = 3 - 4 Mw 15,000
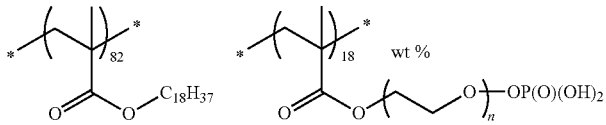
n = 3 - 4
Mw 16,000
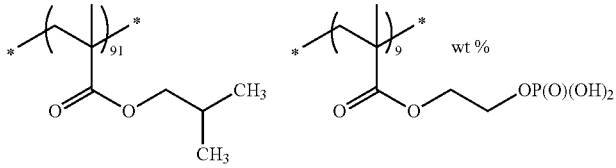
Mw 19,000

-continued

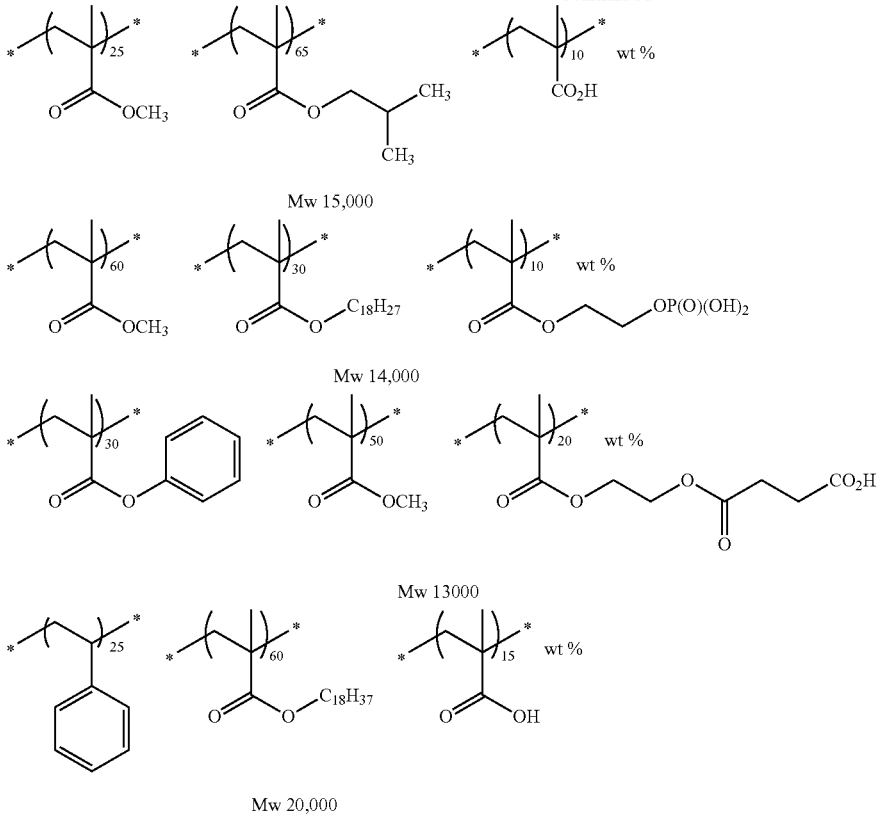

<Formation of Barrier Layer>

In the barrier layer forming step, by applying a solution (hereinafter, referred to as a "barrier layer forming solution") containing the aforementioned acidic group-containing polymer in the aforementioned nonaqueous medium (preferably obtained by dissolving the acidic group-containing polymer in the nonaqueous medium) onto a recording medium and drying the solution, a barrier layer can be formed.

(Recording Medium)

The recording medium used in the image recording method of the present invention is preferably a paper medium. That is, it is possible to use general printing paper mainly consists of cellulose, such as so-called fine paper, coated paper, and art paper used in general offset printing and the like.

As the recording medium, a commercially available general recording medium can be used. Examples of thereof include fine paper (A) such as "OK PRINCE FINE" manufactured by Oji Paper Co., Ltd., "SHIRAOI" manufactured by NIPPON PAPER INDUSTRIES CO., LTD., and "NEW NPI FINE" manufactured by NIPPON PAPER INDUSTRIES CO., LTD., fine coated paper such as "SILVERDIA" manufactured by NIPPON PAPER INDUSTRIES CO., LTD., lightly coated paper such as "OK EVERLIGHT COAT" manufactured by Oji Paper Co., Ltd. and "AURORA S" manufactured by NIPPON PAPER INDUSTRIES CO., LTD., lightweight coated paper (A3) such as "OK COAT L" manufactured by Oji Paper Co., Ltd. and "AURORA L" manufactured by NIPPON PAPER INDUSTRIES CO., LTD., coated paper (A2, B2) such as "OK TOPCOAT+" manufactured by Oji Paper Co., Ltd. and "AURORA COAT" manufactured by NIPPON PAPER INDUSTRIES CO., LTD., art paper (A1) such as "OK KINFUJI+" manufactured by Oji Paper Co., Ltd. and "TOKUBISHI ART" manufactured by MITSUIBISHI PAPER MILLS LIMITED, and the like. Furthermore, various exclusive paper for photograph for ink jet recording can also be used.

Among the above recording media, so-called coated paper used in general offset printing and the like is preferable. The coated paper is obtained by providing a coating layer on the surface of fine paper, alkaline paper, or the like which mainly consists of cellulose and generally has not undergone a surface treatment, by coating the surface with a coating material. It is particularly preferable to use coated paper having base paper and a heavy calcium bicarbonate-containing coating layer. Furthermore, it is preferable to use coated paper having a base paper and a coating layer containing kaolin and heavy calcium bicarbonate. More specifically, art paper, coated paper, lightweight coated paper, or lightly coated paper is more preferable.

From the viewpoint of a strong effect of inhibiting the migration of coloring materials and from the viewpoint of obtaining a high-quality image which has excellent color density and hue better than those of the related art, a water absorption coefficient Ka of the recording medium is preferably 0.05 to 0.5 $mL/m^2 \cdot ms^{1/2}$, more preferably 0.1 to 0.4 $mL/m^2 \cdot ms^{1/2}$, and even more preferably 0.2 to 0.3 $mL/m^2 \cdot ms^{1/2}$.

The water absorption coefficient Ka has the same definition as the absorption coefficient described in JAPAN TAPPI paper pulp test method No. 51:2000 (published from Japan Tappi.). Specifically, by using an automatic scanning liquid absorptometer KM500Win (manufactured by KUMAGAI RIKI KOGYO Co., Ltd.), the amounts of water transferred are measured at a contact time of 100 ms and a contact time of 900 ms, and from a difference therebetween, the water absorption coefficient Ka is calculated.

(Barrier Layer Forming Solution and Application Thereof onto Recording Medium)

The method for applying the barrier layer forming solution onto the recording medium is not particularly limited, and a known liquid application method can be used without particular limitation. For example, it is possible to adopt a wide variety of methods such as an ink jet method, a spray coating method, a roller coating method, and a dipping method.

Specific examples of the method for applying the barrier layer forming solution include a size press method represented by a horizontal size press method, a roll coater method, a calendar size press method, or the like; a size press method represented by an air knife coater method or the like; a knife coater method represented by an air knife coater method or the like; a roll coater method represented by a transfer roll coater method such as gate roll coater method, a direct roll coater method, a reverse roll coater method, a squeeze roll coater method, or the like; a building blade coater method; a short dwell coater method; a blade coater method represented by a two stream coater method or the like; a bar coater method represented by a rod bar coater method or the like; a cast coater method; a gravure coater method; a curtain coater method; a die coater method, a brush coater method; a transfer method; and the like.

Furthermore, a method may be used in which the coating amount is controlled by using a coating device that includes a liquid amount restriction member just like the coating device described in JP1998-230201A (JP-H10-230201A).

The barrier layer forming solution may be applied by full application through which the solution is applied to the entirety of the recording medium or by partial application through which the solution is partially applied to a region to which an ink will be applied in an ink applying step.

From the viewpoint of the degree of glossiness, the barrier layer forming solution is preferably applied onto the recording medium such that the amount of the acidic group-containing polymer in the barrier layer becomes less than 10 $g/m^2$. From the viewpoint of wettability, the solution is more preferably applied such that the amount of the acidic group-containing polymer in the barrier layer becomes equal to or greater than 0.1 $g/m^2$. The barrier layer forming solution is applied onto the recording medium such that the amount of the acidic group-containing polymer in the barrier layer more preferably becomes 0.2 to 10 $g/m^2$, even more preferably becomes 0.2 to 7.5 $g/m^2$, still more preferably becomes 0.3 to 5 $g/m^2$, particularly preferably becomes 0.5 to 3 $g/m^2$, and most preferably becomes 0.5 to 1.8 $g/m^2$.

In order to make the amount of the acidic group-containing polymer in the barrier layer fall into the aforementioned preferred range, the concentration of the acidic group-containing polymer in the barrier layer forming solution is preferably 1% to 50% by mass, more preferably 3% to 45% by mass, and even more preferably 5% to 40% by mass.

From the viewpoint of coating suitability, the viscosity of the barrier layer forming solution at a temperature of 25° C. is preferably 0.1 to 100 mPa·s, and more preferably 0.3 to 50 mPa·s. The viscosity is measured based on JIS Z8803.

The barrier layer forming solution may contain a surfactant, an anti-foaming agent, a low-molecular weight organic acid, a pH adjuster, a viscosity adjuster, a preservative, a rust inhibitor, and the like, in addition to the acidic group-containing polymer.

The drying treatment following the application of the barrier layer forming solution onto the recording medium is not particularly limited. For example, by performing the drying treatment through a heating treatment (performed at a temperature of 40° C. to 250° C., preferably at a temperature of 50° C. to 200° C., and more preferably at a temperature of 60° C. to 150° C.), a blasting treatment (such as exposing the recording medium to dry air), or the like, the barrier layer can be formed, and a recording medium with a barrier layer can be obtained.

[Step (b) (Aggregation-Inducing Layer Forming Step)]

In the step (b), an organic acid-containing layer (hereinafter, referred to as an "aggregation-inducing layer") is formed on the barrier layer of the recording medium on which the barrier layer is formed in the step (a). The aggregation-inducing layer acts on the aqueous ink applied thereonto so as to cause the aggregation of ink components such as a pigment. In this way, the aggregation-inducing layer enables the image formed of the aqueous ink to be fixed onto the recording medium.

The aggregation-inducing layer can be formed by applying an organic acid-containing solution (hereinafter, referred to as an "organic acid solution") onto the barrier layer formed in the step (a) and drying the solution. The organic acid solution is generally an aqueous solution.

<Organic Acid>

The organic acid is a compound which induces the aggregation (immobilization) of the components in the aqueous ink by contacting the aqueous ink on the recording medium. That is, the organic acid functions as an immobilizing agent.

Examples of the organic acid include polyacrylic acid, acetic acid, glycolic acid, malonic acid, malic acid, maleic acid, ascorbic acid, succinic acid, glutaric acid, fumaric acid, citric acid, tartaric acid, lactic acid, pyrrolidone carboxylic acid, pyrone carboxylic acid, pyrrole carboxylic acid, furan carboxylic acid, pyridine carboxylic acid, coumaric acid, thiophene carboxylic acid, nicotinic acid, oxalic acid, benzoic acid, and a phosphoric acid compound. From the viewpoint of accomplishing both the inhibition of volatilization and the solubility in a solvent, the organic acid is preferably an acid having a molecular weight of equal to or greater than 35 and equal to or less than 1,000, more preferably an acid having a molecular weight of equal to or greater than 50 and equal to or less than 500, and particularly preferably an acid having a molecular weight of equal to or greater than 50 and equal to or less than 200. Furthermore, from the viewpoint of accomplishing both the prevention of blurring of ink and photocuring properties of the ink, the organic acid is preferably an acid having a pKa (in $H_2O$ at 25° C.) of equal to or greater than −10 and equal to or less than 7, more preferably an acid having a pKa of equal to or greater than 1 and equal to or less than 7, and particularly preferably an acid having a pKa of equal to or greater than 1 and equal to or less than 5.

As the pKa, it is possible to use values calculated by Advanced Chemistry Development (ACD/Labs) Software V11. 02 (1994-2014 ACD/Labs) or values described in documents (such as J. Phys. Chem. A 2011, 115, 6641 to 6645).

As the organic acid used in the present invention, an acidic compound having high water solubility is preferable. From the viewpoint of fixing the entirety of the ink by reacting with the ink components, the organic acid is preferably an acidic compound having three or less hydrogen atoms, and particularly preferably an acidic compound having two or three hydrogen atoms.

The organic acid is preferably one of compound or two or more of compounds selected from DL-malic acid, malonic acid, glutaric acid, maleic acid, and a phosphoric acid compound, and more preferably a combination of malonic acid and malic acid.

As the phosphoric acid compound, an inorganic phosphoric acid compound selected from orthophosphoric acid (hereinafter, simply referred to as "phosphoric acid"), phosphorous acid, hypophosphorous acid, pyrophosphoric acid, metaphosphoric acid, polyphosphoric acid, and a salt of these is preferable.

The content of the organic acid in the organic acid solution is preferably equal to or less than 40% by mass, more preferably 15% to 40% by mass, even more preferably 15% to 35% by mass, and particularly preferably 20% to 30% by mass. In a case where the content of the organic acid in the organic acid solution is 15% to 40% by mass, the components in the ink can be more efficiently fixed.

From the viewpoint of facilitating the aggregation of the ink composition, the pH of the organic acid solution is preferably 0.1 to 6.0 and more preferably 0.5 to 5.0 at a temperature of 25° C.

Furthermore, from the viewpoint of coating properties, the viscosity of the organic acid solution at a temperature of 25° C. is preferably 0.1 to 100 mPa·s, and more preferably 0.5 to 80 mPa·s. The viscosity can be measured by the same method as the method for measuring the viscosity of the aforementioned barrier layer forming solution.

The amount of the organic acid solution applied onto the barrier layer is not particularly limited as long as the amount is enough for causing the aggregation of the aqueous ink. However, from the viewpoint of facilitating the fixing of the aqueous ink, it is preferable that the organic acid solution is applied such that the amount of the organic acid applied becomes 0.1 $g/m^2$ to 2.0 $g/m^2$. It is more preferable that a treatment agent is applied such that the amount of the organic acid applied becomes 0.2 $g/m^2$ to 1.5 $g/m^2$.

The organic acid solution may further contain a water-soluble organic solvent or a surfactant, in addition to the aforementioned organic acid and water. Furthermore, the organic acid solution may contain known additives such as an ultraviolet absorber, a fading inhibitor, an antifungal agent, a pH adjuster, a rust inhibitor, an antioxidant, an emulsion stabilizer, a preservative, an anti-foaming agent, a viscosity adjuster, a dispersion stabilizer, and a chelating agent.

<Application of Organic Acid Solution onto Barrier Layer>

The method for applying the organic acid solution onto the barrier layer is not particularly limited, and it is possible to use the same method as the method for applying the barrier layer forming solution onto the recording medium.

The drying treatment following the application of the organic acid solution onto the barrier layer is not particularly limited. For example, by drying the solution through a heating treatment, blasting (for example, exposing the recording medium to dry air), and the like, the aggregation-inducing layer can be formed.

[Step (c) (Image Forming Step)]

In the step (c), by jetting an aqueous ink onto the aggregation-inducing layer by an ink jet method, an image is formed.

<Aqueous Ink>

The aqueous ink used in the present invention contains at least a colorant and water, and generally further contains a water-soluble organic solvent. The aqueous ink used in the present invention is in the form of a composition in which the respective components are homogeneously mixed together.

The aqueous ink (hereinafter, simply referred to as an "ink" in some cases) used in the present invention can be used not only for forming a monochromic image, but also for forming a polychromic image (such as a full color image). An image can be formed by selecting the aqueous ink with one intended color or selecting the aqueous inks with two or more intended colors. For forming a full color image, for example, as the inks, it is possible to use inks with magenta tone, cyan tone, and yellow tone can be used. Furthermore, an ink with black tone may also be used.

The aqueous ink used in the present invention may be an ink with yellow (Y) tone, magenta (M) tone, cyan (C) tone, block (K) tone, red (R) tone, green (G) tone, blue (B) tone, or white (W) tone, or may be a so-called special color ink in the field of printing.

The aqueous ink with each color tone described above can be prepared by changing the color of the colorant as intended.

(Colorant)

In the aqueous ink used in the present invention, a known dye, pigment, or the like can be used as a colorant without particular limitation. From the viewpoint of the coloring properties of the formed image, a colorant is preferable which substantially does not dissolve in water or poorly dissolves in water. Specific examples thereof include various pigments, dispersed dyes, oil-soluble dyes, coloring agents forming an J-aggregate, and the like. Considering light fastness, the colorant is more preferably a pigment.

The type of the pigment that can be contained in the aqueous ink used in the present invention is not particularly limited, and general organic or inorganic pigments can be used.

Examples of the organic pigments include an azo pigment, a polycyclic pigment, a chelate dye, a nitro pigment, a nitroso pigment, aniline black, and the like. Among these, an azo pigment or a polycyclic pigment is more preferable. Examples of the azo pigment include azo lake, an insoluble azo pigment, a condensed azo pigment, and a chelate azo pigment. Examples of the polycyclic pigment include a phthalocyanine pigment, a perylene pigment, a perinone pigment, an anthraquinone pigment, a quinacridone pigment, a dioxazine pigment, an indigo pigment, a thioindigo pigment, an isoindolinone pigment, and a quinophthalone pigment. Examples of the chelate dye include a basic chelate dye and an acidic chelate dye.

Examples of the inorganic pigments include titanium oxide, iron oxide, calcium carbonate, barium sulfate, aluminum hydroxide, barium yellow, cadmium red, chromium yellow, carbon black, and the like. Among these, carbon black is preferable. Examples of the carbon black include those manufactured by a known method such as a contact method, a furnace method, or a thermal method.

Specific examples of the pigments that can be used in the present invention include the pigments described in paragraphs "0142" to "0145" in JP2007-100071A and the like.

In a case where a dye is used as a coloring component in the present invention, a dye supported on a water-insoluble support can be used as a colorant. Known dyes can be used as the dye without particular limitation. For example, in the present invention, the dyes described in JP2001-115066A, JP2001-335714A, JP2002-249677A, and the like can also be suitably used. Furthermore, the support is not particularly limited as long as it is insoluble or poorly soluble in water. As the support, an inorganic material, an organic material, or a composite material of these can be used. Specifically, in the present invention, the supports described in JP2001-181549A, JP2007-169418A, and the like can also be suitably used.

The support (colorant) supporting a dye can be used as is. Alternatively, if necessary, it can be used in combination with a dispersant. As the dispersant, a dispersant which will be described later can be suitably used.

One kind of the colorant may be used singly, or plural kinds thereof may be selected and used in combination.

From the viewpoint of the color density, the graininess, the stability of the ink, and the jetting reliability, the content of the colorant in the aqueous ink used in the present invention is preferably 1% to 35% by mass and more preferably 1% to 25% by mass, with respect to the total mass of the aqueous ink.

—Dispersant—

In a case where the aqueous ink used in the present invention is an aqueous ink, and the colorant is a pigment, it is preferable that the pigment constitutes coloring particles dispersed in an aqueous solvent by a dispersant (hereinafter, simply referred to as "coloring particles").

The dispersant may be a polymer dispersant or a low-molecular weight surfactant-type dispersant. Furthermore, the polymer dispersant may be either a water-soluble polymer dispersant or a water-insoluble polymer dispersant.

As the low-molecular weight surfactant-type dispersant, for example, known low-molecular weight surfactant-type dispersants described in paragraphs "0047" to "0052" of JP2011-178029A can be used.

Examples of the water-soluble dispersant among the polymer dispersants include a hydrophilic polymer compound. Examples of a natural hydrophilic polymer compound include a vegetable polymer such as gum Arabic, gum tragacanth, guar gum, karaya gum, locust bean gum, arabinogalactone, pectin, or quince seed starch, a seaweed-based polymer such as alginic acid, carrageenan, or agar, an animal polymer such as gelatin, casein, albumin, or collagen, a microorganism-based polymer such as xanthan gum or dextrin, and the like.

Examples of a modified hydrophilic polymer compound using a natural substance as a raw material include a cellulose-based polymer such as methylcellulose, ethylcellulose, hydroxyethyl cellulose, hydroxypropyl cellulose, or carboxymethyl cellulose, a starch-based polymer such as sodium starch glycolate or sodium starch phosphoric acid ester, a seaweed-based polymer such as sodium alginate or propylene glycol alginic acid ester, and the like.

Examples of a synthetic hydrophilic polymer compound include a vinyl-based polymer such as polyvinyl alcohol, polyvinylpyrrolidone, or polyvinyl methyl ether, an acrylic resin such as non-crosslinked polyacrylamide, polyacrylic acid or an alkali metal salt thereof, or a water-soluble styrene acrylic resin, a water-soluble styrene-maleic acid resin, a water-soluble vinylnaphthalene acrylic resin, a water-soluble vinylnaphthalene-maleic acid resin, a polymer compound having a salt of a cationic functional group such as polyvinylpyrrolidone, polyvinyl alcohol, an alkali metal salt of β-naphthalene sulfonate formalin condensate, quaternary ammonium, or an amino group on a side chain thereof, a natural polymer compound such as shellac, and the like.

Among the above polymers, a hydrophilic polymer compound into which a carboxyl group is introduced, such as a homopolymer of acrylic acid or methacrylic acid or a copolymer of acrylic acid or methacrylic acid with other monomers, is preferable.

The water-insoluble polymer dispersant is not particularly limited as long as it is a water-insoluble polymer and can disperse a pigment, and a water-insoluble polymer dispersant known in the related art can be used. For example, the water-insoluble polymer dispersant can be constituted with both a hydrophobic structural unit and a hydrophilic structural unit.

Examples of the monomer component constituting the hydrophobic structural unit include a styrene-based monomer component, an alkyl (meth)acrylate component, an aromatic group-containing (meth)acrylate component, and the like.

The monomer component constituting the hydrophilic structural unit is not particularly limited as long as it is a monomer component containing a hydrophilic group. Examples of the hydrophilic group include a nonionic group, a carboxyl group, a sulfonic acid group, a phosphoric acid group, and the like. Examples of the nonionic group include a hydroxyl group, an amide group (having an unsubstituted nitrogen atom), a group derived from an alkylene oxide polymer (such as polyethylene oxide or polypropylene oxide), a group derived from sugar alcohol, and the like.

From the viewpoint of the dispersion stability, the hydrophilic structural unit preferably contains at least a carboxyl group. It is also preferable that the hydrophilic structural unit contains both the nonionic group and the carboxyl group.

Specific examples of the water-insoluble polymer dispersant include a styrene-(meth)acrylic acid copolymer, a styrene-(meth)acrylic acid-(meth)acrylic acid ester copolymer, a (meth)acrylic acid ester-(meth)acrylic acid copolymer, a polyethylene glycol (meth)acrylate-(meth)acrylic acid copolymer, a styrene-maleic acid copolymer, and the like.

From the viewpoint of the dispersion stability of the pigment, the water-insoluble polymer dispersant is preferably a vinyl polymer containing a carboxy group, and more preferably a vinyl polymer having at least a structural unit derived from an aromatic group-containing monomer as the hydrophilic structural unit and a structural unit containing a carboxyl group as the hydrophilic structural unit.

From the viewpoint of the dispersion stability of the pigment, the weight-average molecular weight of the water-insoluble polymer dispersant is preferably 3,000 to 200,000, more preferably 5,000 to 100,000, even more preferably 5,000 to 80,000, and particularly preferably 10,000 to 60,000.

In the present specification, the weight-average molecular weight is measured by gel permeation chromatography (GPC). GPC is performed by using HLC-8220 GPC (manufactured by TOSOH CORPORATION) and using TSKgel Super HZM-H, TSKgel Super HZ4000, and TSKgel Super HZ2000 (manufactured by TOSOH CORPORATION, 4.6 mmID×15 cm) as columns. The conditions of GPC are specifically described in paragraph "0076" of JP2010-155359A.

From the viewpoint of the dispersibility of the pigment, the coloring properties of the ink, and the dispersion stability, the content of the dispersant in the coloring particles is preferably 10 to 90 parts by mass, more preferably 20 to 70 parts by mass, and particularly preferably 30 to 50 parts by mass, with respect to 100 parts by mass of the pigment.

It is preferable that the content of the dispersant in the coloring particles is within the above range, because then the pigment is coated with an appropriate amount of the dispersant, and coloring particles which have a small particles size and excellent temporal stability tend to be easily obtained.

For example, the coloring particles can be obtained in the form of a coloring particle dispersion by dispersing a mixture, which contains a pigment, a dispersant, and a solvent (preferably an organic solvent) used if necessary, and the like, by using a disperser.

For example, the coloring particle dispersion can be manufactured by performing a step (mixing•hydrating step) of adding a basic substance-containing aqueous solution to a mixture of the aforementioned pigment, the aforementioned polymer dispersant, and an organic solvent which dissolves or disperses the dispersant, and then performing a step (solvent removing step) of removing the organic solvent. In this way, the colorant is finely dispersed, and a dispersion of coloring particles having excellent preservation stability can be prepared.

The organic solvent needs to be able to dissolve or disperse the dispersant. In addition to this, it is preferable that the organic solvent exhibits affinity with water to some extent. Specifically, at a temperature of 20° C., the degree of solubility of the organic solvent in water is preferably 10% to 50% by mass.

Preferred examples of the organic solvent include water-soluble organic solvents. Among these, isopropanol, acetone, and methyl ethyl ketone are preferable, and methyl ethyl ketone is particularly preferable. One kind of the organic solvent may be used singly, or plural kinds thereof may be used in combination.

The aforementioned basic substance is used for neutralizing an anionic group (preferably a carboxyl group) that the polymer has in some cases. A degree of neutralization of the anionic group is not particularly limited. Generally, the finally obtained coloring particle dispersion preferably has properties in which the pH thereof is 4.5 to 10, for example. The pH can be determined by an intended degree of neutralization of the aforementioned polymer.

In the process of manufacturing the coloring particle dispersion, the method for removing the organic solvent is not particularly limited, and a known method such as distillation under reduced pressure can be used.

In the aqueous ink used in the present invention, one kind of the coloring particles may be used singly, or two or more kinds thereof may be used in combination.

In the present invention, the volume-average particle size of the colorant (or the coloring particles) is preferably 10 to 200 nm, more preferably 10 to 150 nm, and even more preferably 10 to 100 nm. In a case where the volume-average particle size is equal to or less than 200 nm, color reproducibility become excellent, and droplet jetting properties become excellent in the case of an ink jet method. In a case where the volume-average particle size is equal to or greater than 10 nm, light fastness becomes excellent.

The particle size distribution of the colorant (or the coloring particles) is not particularly limited, and may be wide particle size distribution or monodisperse particle size distribution. Furthermore, two or more kinds of colorants having monodisperse particle size distribution may be used by being mixed together.

The volume-average particle size of the colorant (or the coloring particles) can be measured by using a Microtrac particle size distribution analyzer (trade name: Version 10. 1. 2-211BH, manufactured by NIKKISO CO., LTD.) by means of a dynamic light scattering method.

(Solvent)

The aqueous ink used in the present invention contains water as a solvent and generally further contains a water-soluble organic solvent. The content of water in the solvent contained in the aqueous ink is preferably equal to or greater than 10% by mass, more preferably 20% to 100% by mass, even more preferably 30% to 90% by mass, and still more preferably 40% to 80% by mass.

The water-soluble organic solvent which can be contained in the aqueous ink preferably has a degree of solubility in water of equal to or greater than 0.1% by mass at a temperature of 20° C. Examples of the water-soluble organic solvent include an alcohol, ketone, an ether compound, an amide compound, a nitrile compound, and a sulfone compound.

Examples of the alcohol include ethanol, isopropanol, n-butanol, t-butanol, isobutanol, diacetone alcohol, diethylene glycol, ethylene glycol, dipropylene glycol, propylene glycol, and glycerin.

Examples of the ketone include acetone, methyl ethyl ketone, diethyl ketone, and methyl isobutyl ketone.

Examples of the ether compound include dibutyl ether, tetrahydrofuran, and dioxane.

Examples of the amide compound include dimethylformamide and diethylformamide.

Examples of the nitrile compound include acetonitrile.

Examples of the sulfone compound include dimethyl sulfoxide, dimethyl sulfone, and sulfolane.

(Resin Particles)

If necessary, the aqueous ink used in the present invention can contain resin particles. It is preferable that the resin particles have a function of fixing the ink by thickening the ink by being unstably dispersed and aggregated when contacting the aforementioned aggregation-inducing layer. It is preferable that such resin particles are dispersed in at least one of the water and organic solvent.

As the resin particles, it is possible to use an acrylic resin, a vinyl acetate-based resin, a styrene-butadiene-based resin, a vinyl chloride-based resin, an acryl-styrene-based resin, a butadiene-based resin, a styrene-based resin, a crosslinked acrylic resin, a crosslinked styrene-based resin, a benzoguanamine resin, a phenolic resin, a silicone resin, an epoxy resin, a urethane-based resin, a paraffin-based resin, a fluorine-based resin, or latex of these. Among these, an acrylic resin, an acryl-styrene-based resin, a styrene-based resin, a crosslinked acrylic resin, and a crosslinked styrene-based resin are preferable, for example.

It is also possible to use the resin particles in the form of latex.

The weight-average molecular weight of the polymer constituting the resin particles is preferably equal to or greater than 10,000 and equal to or less than 200,000, and more preferably equal to or greater than 20,000 and equal to or less than 200,000.

The volume-average particle size of the resin particles is preferably within a range of 1 nm to 1 μm, more preferably within a range of 1 nm to 200 nm, even more preferably within a range of 2 nm to 100 nm, and particularly preferably within a range of 5 nm to 50 nm. The volume-average particle size of the resin particles can be measured by the same method as used for measuring the volume-average particle size of the aforementioned colorant.

A glass transition temperature Tg of the resin particles is preferably equal to or higher than 30° C., more preferably equal to or higher than 40° C., and even more preferably equal to or higher than 50° C.

Tg can be measured by using a differential scanning calorimeter (DSC) EXSTAR 6220 manufactured by SII NanoTechnology, Inc at a temperature increase rate of 10° C./min. At this time, the average of a temperature, at which a base line starts to change as the resin particles undergo transition to glass, and a temperature that returns to the base line is determined as Tg.

As the resin particles, it is preferable to use self-dispersing resin particles.

The self-dispersing resin particles refer to a water-insoluble resin which can be in a dispersed state in an aqueous medium by a functional group (particularly, an acidic group or a salt thereof) contained in the polymer when the polymer is put into a dispersed state by a phase-inversion emulsification method in the absence of a surfactant.

Herein, the dispersed state includes both of an emulsified state (emulsion) in which the water-insoluble resin is dispersed in a liquid state in an aqueous medium and a dispersed state (dispersion) in which the water-insoluble resin is dispersed in a solid state in an aqueous medium.

As the self-dispersing resin particles, it is possible to use the self-dispersing resin particles described in paragraphs "0090" to "0121" of JP2010-64480A and in paragraphs "0130" to "0167" of JP2011-068085A.

The molecular weight of the water-insoluble polymer constituting the self-dispersing resin particles is preferably 3,000 to 200,000, more preferably 5,000 to 150,000, and even more preferably 10,000 to 100,000, in terms of a weight-average molecular weight. By setting the weight-average molecular weight to be equal to or greater than 3,000, the amount of water-soluble components can be effectively reduced. Furthermore, by setting the weight-average molecular weight to be equal to or less than 200,000, the self-dispersion stability can be improved.

From the viewpoint of controlling the hydrophilicity and hydrophobicity of the polymer, the water-insoluble polymer constituting the self-dispersing resin particles preferably contain a structural unit derived from an aromatic group-containing (meth)acrylate monomer (preferably a structural unit derived from phenoxyethyl (meth)acrylate and/or a structural unit derived from benzyl (meth)acrylate) in an amount of 15% to 80% by mass in terms of a copolymerization ratio, with respect to the total mass of the self-dispersing polymer particles.

Furthermore, from the viewpoint of controlling the hydrophilicity and hydrophobicity of the polymer, the water-insoluble polymer preferably contains a constitutional unit derived from an aromatic group-containing (meth)acrylate monomer in an amount of 15% to 80% by mass in terms of a copolymerization ratio, a constitutional unit derived from a carboxyl group-containing monomer, and a constitutional unit derived from an alkyl group-containing monomer (preferably a structural unit derived from an alkyl ester of (meth)acrylic acid), more preferably contains a structural unit derived from phenoxyethyl (meth)acrylate and/or a structural unit derived from benzyl (meth)acrylate in an amount of 15% to 80% by mass in terms of a copolymerization ratio, a constitutional unit derived from a carboxyl group-containing monomer, and a constitutional unit derived from an alkyl group-containing monomer (preferably a structural unit derived from an alkyl ester of (meth) acrylic acid having 1 to 4 carbon atoms). In addition, the water-insoluble polymer preferably has an acid value of 25 to 100 and a weight-average molecular weight of 3,000 to 200,000, and more preferably has an acid value of 25 to 95 and a weight-average molecular weight of 5,000 to 150,000.

The content of the resin particles is preferably 0.1% to 20% by mass and more preferably 0.1% to 10% by mass, with respect to the total mass of the aqueous ink.

The particle size distribution of the resin particles is not particularly limited, and may be wide particle size distribution or monodisperse particle size distribution. Furthermore, two or more kinds of resin particles having monodisperse particle size distribution may be used by being mixed together.

(Surfactant)

The aqueous ink used in the present invention may contain a surfactant as a surface tension adjuster.

As the surfactant, it is possible to use any of an anionic surfactant, a cationic surfactant, an amphoteric surfactant, a nonionic surfactant, and a betaine-based surfactant.

Specific examples of the anionic surfactant include sodium dodecylbenzenesulfonate, sodium lauryl sulfate, sodium alkyl diphenyl ether disulfonate, sodium alkyl naphthalene sulfonate, sodium dialkyl sulfosuccinate, sodium stearate, potassium oleate, sodium dioctylsulfosuccinate, sodium polyoxyethylene alkyl ether sulfate, sodium polyoxyethylene alkyl ether sulfate, sodium polyoxyethylene alkyl phenyl ether sulfate, sodium dialkyl sulfosuccinate, sodium stearate, sodium oleate, a sodium t-octylphenoxyethoxypolyethoxyethyl sulfate salt, and the like. One kind of surfactant or two or more kinds of surfactants can be selected from these.

Specific examples of the nonionic surfactant include acetylene diol derivative such as an ethylene oxide adduct of acetylene diol, polyoxyethylene lauryl ether, polyoxyethylene octylphenyl ether, polyoxyethylene oleyl phenyl ether, polyoxyethylene nonylphenyl ether, oxyethylene•oxypropylene block copolymer, t-octyl phenoxyethyl polyethoxy ethanol, nonyl phenoxyethyl polyethoxy ethanol, and the like. One kind of surfactant or two or more kinds of surfactants can be selected from these.

Examples of the cationic surfactant include a tetraalkyl ammonium salt, an alkyl amine salt, a benzalkonium salt, an alkylpyridium salt, an imidazolium salt, and the like. Specific examples thereof include dihydroxy ethyl stearylamine, 2-heptadecenyl-hydroxyethyl imidazoline, lauryl dimethyl benzyl ammonium chloride, cetylpyridinium chloride, stearamide methyl pyridium chloride, and the like.

Among these surfactants, from the viewpoint of the stability, a nonionic surfactant is preferable, and an acetylene diol derivative is more preferable.

In a case where the aqueous ink used in the present invention is used in an ink jet recording method, from the viewpoint of jetting properties of the ink, the amount of the surfactant is preferably adjusted such that the surface tension of the aqueous ink becomes 20 to 60 mN/m, more preferably adjusted such that the surface tension becomes 20 to 45 mN/m, and more preferably adjusted such that the surface tension becomes 25 to 40 mN/m.

The surface tension of the aqueous ink is measured by using an Automatic Surface Tensiometer CBVP-Z (manufactured by Kyowa Interface Science Co., LTD.) at a temperature of 25° C.

The content of the surfactant in the aqueous ink is preferably an amount that enables the surface tension of the aqueous ink to fall into the aforementioned range. More specifically, the content of the surfactant in the aqueous ink is preferably equal to or greater than 0.1% by mass, more preferably 0.1% to 10% by mass, and even more preferably 0.2% to 3% by mass.

(Other Components)

If necessary, the aqueous ink used in the present invention may be mixed with additives such as a dehydration inhibitor (swelling agent), a desiccant, a coloration inhibitor, a penetration enhancer, an ultraviolet absorber, a preservative, a rust inhibitor, an anti-foaming agent, a viscosity adjuster, a pH adjuster, and a chelating agent. The mixing method is not particularly limited, and by appropriately selecting a generally used mixing method, the aqueous ink can be obtained.

(Physical Properties of Aqueous Ink)

The viscosity at a temperature of 25° C. of the aqueous ink used in the present invention is preferably equal to or greater than 1.2 mPa·s and equal to or less than 15.0 mPa·s, more preferably equal to or greater than 2 mPa·s and less than 13 mPa·s, and even more preferably equal to or greater than 2.5 mPa·s and less than 10 mPa·s.

The viscosity of the aqueous ink is measured by using a VISCOMETER TV-22 (manufactured by TOKI SANGYO CO., LTD.) at a temperature of 25° C.

From the viewpoint of the dispersion stability at a temperature of 25° C., the pH of the aqueous ink used in the present invention is preferably 6 to 11, more preferably 7 to 10, and even more preferably 7 to 9.

<Image Formation>

By applying the aqueous ink onto the aggregation-inducing layer, an intended image can be formed. In the present invention, the aqueous ink is jetted onto the aggregation-inducing layer by an ink jet method.

As the recording method using the ink jet method preferable in the present invention, it is possible to adopt the method described in paragraphs "0093" to "0105" of JP2003-306623A. Hereinafter, the ink jet method will be more specifically described.

(Ink Jet Method)

The ink jet method used for image recording of the present invention is not particularly limited, and a known method can be adopted. For example, the ink jet method may be any of an electric charge control method in which an ink is jetted by using electrostatic attraction force; a drop-on-demand method (a pressure pulse method) using vibration pressure of a piezoelectric element; an acoustic ink jet method in which an ink is irradiated with an acoustic beam converted from an electric signal and the ink is jetted by using the radiation pressure; and a thermal ink jet method in which air bubbles are formed by heating an ink and the thus generated pressure is used; and the like.

Furthermore, an ink jet head used in the ink jet method may be an on-demand type or a continuous type. In addition, an ink nozzle or the like used at the time of performing recording by the ink jet method is not particularly limited, and can be appropriately selected according to the purpose.

The ink jet method includes a method of jetting a large number of low-concentration inks called photo inks in a small volume, a method of improving image quality by using a plurality of inks which have substantially the same color but different densities, and a method of using a colorless and transparent ink.

The ink jet method also includes a shuttle method of using a short serial head, in which recording is performed while a recording medium is being scanned in a width direction by the head, and a line method of using a line head in which recording elements are arranged to correspond to the entire region of one side of a recording medium. In the line method, the recording medium is scanned in a direction orthogonal to the arrangement direction of the recording elements, and accordingly, an image can be recorded on the entire surface of the recording medium, and a transport system such as a carriage scanning the short head is not required. Moreover, complicated scanning control for moving a carriage and a recording medium is not required, and only the recording medium is moved. Therefore, the recording speed in the line method can be increased to more than that in the shuttle method.

In a case where an ink applying step is performed by the ink jet method, from the viewpoint of forming a high-definition print, the amount of the aqueous ink droplets jetted by the ink jet method is preferably 1.5 to 3.0 pL, and more preferably 1.5 to 2.5 pL. The amount of the aqueous ink droplets jetted can be regulated by appropriately adjusting the jetting conditions.

(Ink Drying Step)

If necessary, the step (c) may include an ink drying step of drying and removing a solvent (such as water or the aforementioned aqueous medium) in the aqueous ink applied onto the aggregation-inducing layer. The ink drying step is not particularly limited as long as at least a portion of the solvent of the ink can be removed, and a generally used method can be adopted.

(Thermal Fixing Step)

If necessary, the step (c) preferably includes a thermal fixing step after the ink drying step. By performing the thermal fixing treatment, the image on the recording medium can be fixed, and the scratch resistance of the image can be further improved. As the thermal fixing step, for example, it is possible to adopt the thermal fixing step described in paragraphs "0112" to "0120" of JP2010-221415A.

(Ink Removing Step)

If necessary, the ink jet recording method of the present invention may include an ink removing step of removing the aqueous ink (such as solids of the ink solidified by drying) having adhered to the ink jet recording head by using a maintenance liquid. Specifically, as the maintenance liquid and the ink removing step, the maintenance liquid and the ink removing step described in WO2013/180074A can be preferably adopted.

EXAMPLES

Hereinafter, the present invention will be more specifically described based on examples, but the present invention is not limited to the examples. Herein, unless otherwise specified, "part" and "%" showing the composition are based on mass.

Abbreviation

The abbreviation described in the present example means the following.

MMA: methyl methacrylate (manufactured by Wako Pure Chemical Industries, Ltd.)

MAA: methacrylic acid (manufactured by Wako Pure Chemical Industries, Ltd.)

EtMA: ethyl methacrylate (manufactured by Wako Pure Chemical Industries, Ltd.)

nBuMA: normal butyl methacrylate (manufactured by Wako Pure Chemical Industries, Ltd.)

iBuMA: isobutyl methacrylate (manufactured by Wako Pure Chemical Industries, Ltd.)

tBuMA: t-butyl methacrylate (manufactured by Wako Pure Chemical Industries, Ltd.)

HMA: hexyl methacrylate (manufactured by Wako Pure Chemical Industries, Ltd.)

BzMA: benzyl methacrylate (manufactured by Wako Pure Chemical Industries, Ltd.)

EHMA: 2-ethylhexyl methacrylate (manufactured by Wako Pure Chemical Industries, Ltd.)

C12MA: dodecyl methacrylate (manufactured by Wako Pure Chemical Industries, Ltd.)

C18MA: stearyl methacrylate (manufactured by Wako Pure Chemical Industries, Ltd.)

IBOMA: isobornyl methacrylate (manufactured by Wako Pure Chemical Industries, Ltd.)

HO-MS: 2-methacryloyloxyethyl succinate (manufactured by KYOEISHA CHEMICAL Co., LTD)

PhMA: phenyl methacrylate (manufactured by Sigma-Aldrich Co. LLC.)

CB-1: 2-methacryloyloxyethyl phthalate (manufactured by SHIN-NAKAMURA CHEMICAL CO., LTD.)

StCOOH: vinylbenzoic acid (manufactured by TOKYO CHEMICAL INDUSTRY CO., LTD.)

AMPS: 2-acrylamide-2-methylpropane sulfonic acid (manufactured by TOKYO CHEMICAL INDUSTRY CO., LTD.)

PHOSMER M: 2-(methacryloyloxy)ethyl phosphate (manufactured by Uni-Chemical Co., Ltd.)

PHOSMER PE: 2-(methacryloyloxy)polyoxyethyl phosphate (manufactured by Uni-Chemical Co., Ltd.)

HEMA: hydroxyethyl methacrylate (manufactured by Wako Pure Chemical Industries, Ltd.)

St: styrene (manufactured by Wako Pure Chemical Industries, Ltd.)

V-65: 2,2'-azobis(2,4-dimethylvaleronitrile) (manufactured by Wako Pure Chemical Industries, Ltd.)

V-601: dimethyl 2,2-azobis(2-methylpropionate) (manufactured by Wako Pure Chemical Industries, Ltd.)

MEK: 2-butanone (manufactured by Wako Pure Chemical Industries, Ltd., moisture content: 0.02% by mass)

Mw: weight-average molecular weight

The polymers shown below were synthesized.

A-1

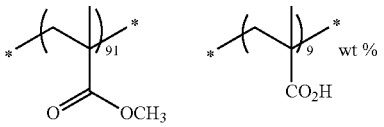

Mw 13,000

A-2

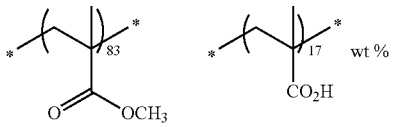

Mw 14,000

A-3

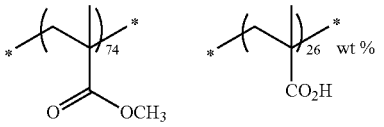

Mw 15,000

A-4

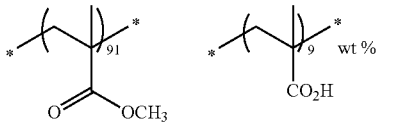

Mw 4,000

A-5

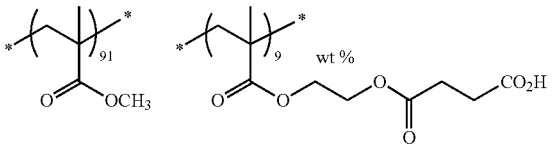

Mw 13,000

A-6

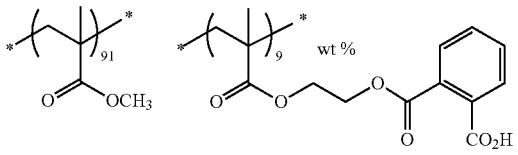

Mw 12,000

A-7

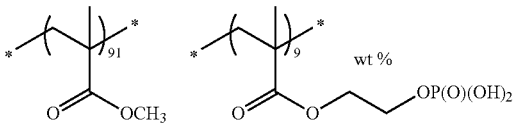

Mw 18,000

A-8

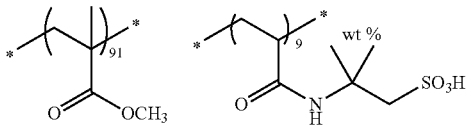

Mw 8,000

A-9

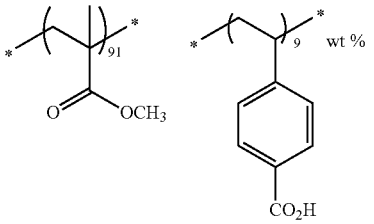

Mw 9,000

A-10

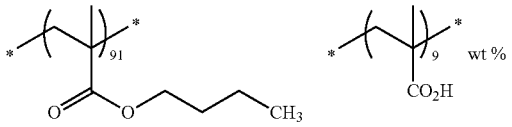

Mw 9,000

-continued
A-11
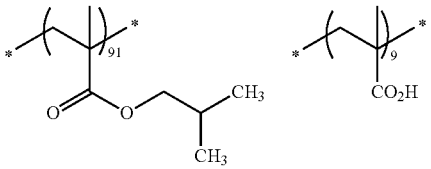
Mw 9,000
A-12
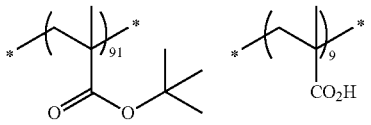
Mw 12,000
A-13
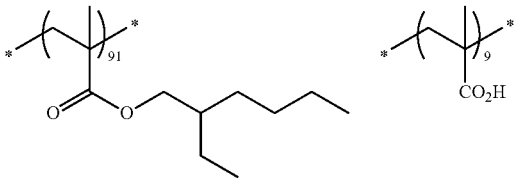
Mw 12,000
A-14
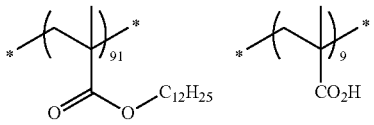
Mw 18,000
A-15
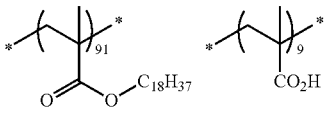
Mw 15,000
A-16
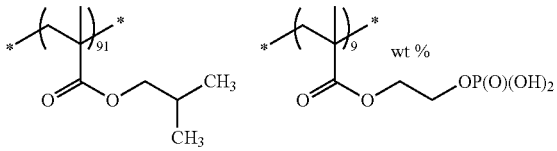
Mw 19,000
A-17
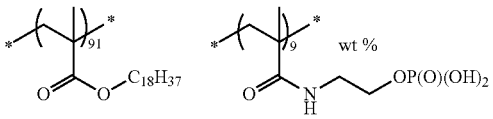
Mw 13,000
A-18
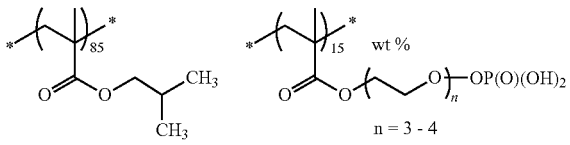
Mw 16,000
A-19
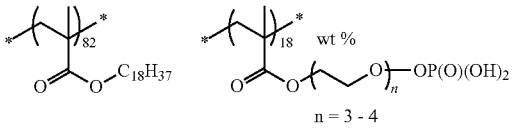
Mw 16,000
A-20
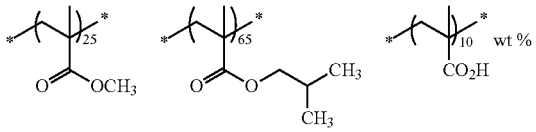
Mw 15,000
A-21
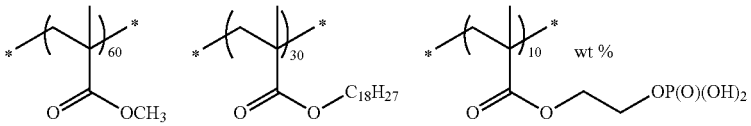
Mw 14,000
A-22
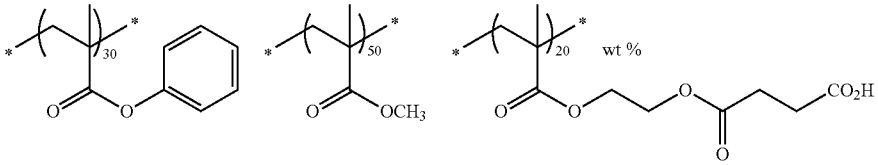
Mw 13000

-continued

A-23

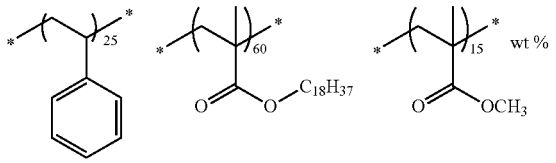

Mw 20,000

B-1

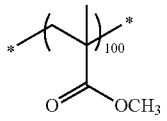

Mw 16,000

[Synthesis Example 1] Synthesis of Polymer A-1

MEK (104.06 g) was put into a three-neck flask and heated to 85° C. in a nitrogen atmosphere. A solution, which was obtained by dissolving MMA (63.652 g), MAA (6.33 g), and V-601 (2.79 g, 1.2 mol % with respect to a total molar amount of 100 mol % of the monomer) in MEK (25 g), was added dropwise to the three-neck flask for 2 hours. After the dropwise addition ended, the solution was stirred for 4 hours at 85° C. Then, a solution, which was obtained by dissolving 1.39 g of V-601 in 1 g of MEK, was added to the three-neck flask, followed by stirring for 2 hours at 85° C. so as to finish the reaction, thereby obtaining a polymer A-1. The acid value of the obtained polymer A-1 was 58.9 mgKOH/g, and the weight-average molecular weight thereof was 13,000.

[Synthesis Example 2] Synthesis of Polymer A-2

MEK (104.06 g) was put into a three-neck flask and heated to 85° C. in a nitrogen atmosphere. A solution, which was obtained by dissolving MMA (63.652 g), MAA (6.33 g), and V-601 (5.58 g, 2.4 mol % with respect to a total molar amount of 100 mol % of the monomer) in MEK (25 g), was added dropwise to the three-neck flask for 2 hours. After the dropwise addition ended, the solution was stirred for 4 hours at 85° C. Then, a solution, which was obtained by dissolving 1.39 g of V-601 in 1 g of MEK, was added to the three-neck flask, followed by stirring for 2 hours at 85° C. so as to finish the reaction, thereby obtaining a polymer A-2. The acid value of the obtained polymer A-2 was 110.5 mgKOH/g, and the weight-average molecular weight thereof was 14,000.

[Synthesis Examples 3 to 23] Synthesis of Polymers A-3 to A-23

Polymers A-3 to A-23 were synthesized in the same manner as in Synthesis Example 1, except that in Synthesis Example 1, the type and amount of the used monomer were changed such that mass ratio of the constitutional units shown in the structural formulae of the polymers A-3 to A-23 was satisfied.

[Comparative Synthesis Example 1] Synthesis of Polymer B-1

A polymer B-1 was synthesized in the same manner as in Synthesis Example 1, except that, in Synthesis Example 1, MAA was not used.

The composition, the weight-average molecular weight, and the acid value of the polymers prepared in each of the above synthesis examples and comparative synthesis examples are summarized in the following Table 1.

TABLE 1

| | | Monomer species used | | | Quantitative ratio of monomer species (mass ratio) | | | | Acid value |
|---|---|---|---|---|---|---|---|---|---|
| | Polymer | Monomer 1 | Monomer 2 | Monomer 3 | Monomer 1 | Monomer 2 | Monomer 3 | Mw | [mgKOH/g] |
| Synthesis Example 1 | A-1 | MMA | MAA | | 91 | 9 | | 13000 | 58.9 |
| Synthesis Example 2 | A-2 | MMA | MAA | | 83 | 17 | | 14000 | 110.5 |
| Synthesis Example 3 | A-3 | MMA | MAA | | 74 | 26 | | 15000 | 169.4 |
| Synthesis Example 4 | A-4 | MMA | MAA | | 91 | 9 | | 4000 | 58.9 |
| Synthesis Example 5 | A-5 | MMA | HO-MS | | 91 | 9 | | 13000 | 21.9 |
| Synthesis Example 6 | A-6 | MMA | CB-1 | | 91 | 9 | | 12000 | 18.0 |
| Synthesis Example 7 | A-7 | MMA | PHOSMER M | | 91 | 9 | | 18000 | 51.1 |
| Synthesis Example 8 | A-8 | MMA | AMPS | | 91 | 9 | | 8000 | 36.5 |
| Synthesis Example 9 | A-9 | MMA | StCOOH | | 91 | 9 | | 9000 | 34.2 |
| Synthesis Example 10 | A-10 | nBuMA | MAA | | 91 | 9 | | 9000 | 58.9 |
| Synthesis Example 11 | A-11 | iBuMA | MAA | | 91 | 9 | | 9000 | 58.9 |
| Synthesis Example 12 | A-12 | tBuMA | MAA | | 91 | 9 | | 12000 | 58.9 |
| Synthesis Example 13 | A-13 | EHMA | MAA | | 91 | 9 | | 12000 | 58.9 |

TABLE 1-continued

| | Polymer | Monomer species used | | | Quantitative ratio of monomer species (mass ratio) | | | Mw | Acid value [mgKOH/g] |
|---|---|---|---|---|---|---|---|---|---|
| | | Monomer 1 | Monomer 2 | Monomer 3 | Monomer 1 | Monomer 2 | Monomer 3 | | |
| Synthesis Example 14 | A-14 | C12MA | MAA | | 91 | 9 | | 18000 | 58.9 |
| Synthesis Example 15 | A-15 | C18MA | MAA | | 91 | 9 | | 15000 | 58.9 |
| Synthesis Example 16 | A-16 | iBuMA | PHOSMER M | | 91 | 9 | | 19000 | 24.1 |
| Synthesis Example 17 | A-17 | C18MA | PHOSMER M | | 91 | 9 | | 13000 | 24.1 |
| Synthesis Example 18 | A-18 | iBuMA | PHOSMER PE | | 85 | 15 | | 16000 | 23.0 |
| Synthesis Example 19 | A-19 | C18MA | PHOSMER PE | | 82 | 18 | | 16000 | 23.0 |
| Synthesis Example 20 | A-20 | MMA | iBuMA | MAA | 25 | 65 | 10 | 15000 | 58.9 |
| Synthesis Example 21 | A-21 | MMA | C18MA | PHOSMER M | 60 | 30 | 10 | 14000 | 24.1 |
| Synthesis Example 22 | A-22 | PhMA | MMA | HO-MS | 30 | 50 | 20 | 13000 | 48.8 |
| Synthesis Example 23 | A-23 | St | C18MA | MAA | 25 | 60 | 15 | 19500 | 97.6 |
| Comparative Synthesis Example 1 | B-1 | MMA | | | 100 | | | 16000 | — |

[Formation of Barrier Layer]

Each of the polymers synthesized in the aforementioned synthesis examples and comparative synthesis examples was diluted with MEK, thereby preparing 23 kinds of polymer solutions (barrier layer forming solutions) in which each of the polymers was dissolved in an amount of 15.8% by mass. The viscosity of the obtained barrier layer forming solution at a temperature of 25° C. was within a range of 0.3 to 5.2 mPa·s.

A coating layer of an A4 size recording medium (OK TOPCOAT 127, manufactured by Oji Paper Co., Ltd., having a coating layer containing calcium carbonate) was fully coated with the barrier layer forming solution such that the coating amount of the polymer became the amount described in the following Table 3. Then, the solution was dried for 10 minutes at 80° C., thereby forming a barrier layer.

[Formation of Aggregation-Inducing Layer]

An organic acid solution having the following composition was prepared.

| | |
|---|---|
| Malonic acid (manufactured by Wako Pure Chemical Industries, Ltd.) | 11.3% by mass |
| Malic acid (manufactured by Wako Pure Chemical Industries, Ltd.) | 14.5% by mass |
| DEGmBE (diethylene glycol monobutyl ether) | 7.5% by mass |
| TEGmME (triethylene glycol monomethyl ether) | 2.5% by mass |
| Deionized water | Balance |

The pH and the viscosity of the obtained organic acid solution at a temperature of 25° C. were 1.1 and 0.6 mPa·s respectively.

By using a bar coater, the barrier layer formed on the recording medium was fully coated with the organic acid solution prepared as above such that the coating amount of the organic acid became 0.25 g/m$^2$. Then, the solution was dried for 2 seconds at 50° C., thereby forming an aggregation-inducing layer.

[Preparation of Ink]

<Synthesis of Polymer Dispersant P-1>

A polymer dispersant P-1 was synthesized as below.

88 g of methyl ethyl ketone was put into a 1,000 ml three-neck flask equipped with a stirrer and a cooling pipe and heated to 72° C. in a nitrogen atmosphere. To the resultant, a solution, which was obtained by dissolving 0.85 g of dimethyl 2,2'-azobisisobutyrate, 60 g of benzyl methacrylate, 10 g of methacrylic acid, and 30 g of methyl methacrylate in 50 g of methyl ethyl ketone, was added dropwise over 3 hours. After the dropwise addition ended, the resultant was further reacted for 1 hour at 72° C., a solution, which was obtained by dissolving 0.42 g of dimethyl 2,2'-azobisisobutyrate in 2 g of methyl ethyl ketone, was added thereto, and the resultant was heated to 78° C. for 4 hours. The obtained reaction solution was reprecipitated twice in a large excess of hexane, and the precipitated resin was dried, thereby obtaining 96 g of a polymer dispersant P-1.

The composition of the obtained polymer dispersant was checked by $^1$H-NMR. The polymer dispersant had a weight-average molecular weight of 44,600. Furthermore, as a result of measuring an acid value thereof by the method described in JIS standard (JIS K 0070:1992), an acid value of 1.16 mgKOH/g was obtained.

<Preparation of Pigment Dispersion>

(Preparation of Cyan Dispersion)

10 parts of Pigment Blue 15:3 (phthalocyanine blue A220, manufactured by Dainichiseika Color & Chemicals Mfg. Co., Ltd.) as a cyan pigment, 5 parts of the polymer dispersant P-1, 42 parts of methyl ethyl ketone, 5.5 parts of an 1N aqueous NaOH solution, and 87.2 parts of deionized water were mixed together and dispersed for 2 to 6 hours by a beads mill using 0.1 mmφ zirconia beads.

From the obtained dispersion, methyl ethyl ketone was removed under reduced pressure at a temperature of 55° C., and then a portion of water was removed. Furthermore, by using a high-speed refrigerated centrifuge 7550 (manufactured by KUBOTA CORPORATION) and a 50 mL centrifuge tube, the dispersion was subjected to a centrifugation treatment for 30 minutes at 8,000 rpm, and the supernatant liquid other than the precipitate was collected.

Then, the pigment concentration was determined from the absorbance spectrum, thereby obtaining a dispersion (cyan dispersion C) of resin-coated pigment particles (pigment coated with the polymer dispersant) having a pigment concentration of 10.2% by mass. The volume average particle size of the pigment particles of the obtained cyan dispersion C was 105 nm.

The volume average particle size was measured by a dynamic light scattering method by using a nanotrac particle size distribution analyzer UPA-EX150 (manufactured by NIKKISO CO., LTD.).

(Preparation of Magenta Dispersion)

A dispersion (magenta dispersion M) of resin-coated pigment particles (pigment coated with the polymer dispersant) was prepared in the same manner as in the preparation of the cyan dispersion, except that in the preparation of the cyan dispersion, Pigment Red 122 as a magenta pigment was used instead of Pigment Blue 15:3 (phthalocyanine blue A220, manufactured by Dainichiseika Color & Chemicals Mfg Co., Ltd.). The volume average particle size of the obtained magenta dispersion M was 85 nm.

(Preparation of Yellow Dispersion)

A dispersion (yellow dispersion Y) of resin-coated pigment particles (pigment coated with the polymer dispersant) was prepared in the same manner as in the preparation of the cyan dispersion, except that in the preparation of the cyan dispersion, Pigment Yellow 74 as a yellow pigment was used instead of Pigment Blue 15:3 (phthalocyanine blue A220, manufactured by Dainichiseika Color & Chemicals Mfg Co., Ltd.). The volume average particle size of the obtained yellow dispersion Y was 82 nm.

(Preparation of Black Dispersion)

A dispersion (black dispersion K) of resin-coated pigment particles (pigment coated with the polymer dispersant) was prepared in the same manner as in the preparation of the cyan dispersion, except that in the preparation of the cyan dispersion, carbon black (NIPEX 160-IQ manufactured by Evonik Degussa Co., Ltd.) as a black pigment was used instead of Pigment Blue 15:3 (phthalocyanine blue A220, manufactured by Dainichiseika Color & Chemicals Mfg Co., Ltd.). The volume average particle size of the obtained black dispersion K was 130 nm.

<Preparation of Self-Dispersing Resin Particles D-01>

A 2 L three-neck flask equipped with a stirrer, a thermometer, a reflux condenser tube, and a nitrogen gas inlet tube was filled with 360.0 g of methyl ethyl ketone and heated to 75° C. In a state where the internal temperature of the reaction container was kept at 75° C., a mixed solution composed of 180.0 g of phenoxyethyl acrylate, 162.0 g of methyl methacrylate, 18.0 g of acrylic acid, 72 g of methyl ethyl ketone, and 1.44 g of "V-601" (manufactured by Wako Pure Chemical Industries, Ltd.) was added dropwise thereto at a constant speed such that the dropwise addition was completed in 2 hours. After the dropwise addition was completed, a solution composed of 0.72 g of "V-601" and 36.0 g of methyl ethyl ketone was added thereto, and the resultant was stirred for 2 hours at a temperature of 75° C. Then a solution composed of 0.72 g of "V-601" and 36.0 g of isopropanol was added thereto, and the resultant was stirred for 2 hours at a temperature of 75° C. Thereafter, the resultant was heated to 85° C. and continuously stirred for two more hours. The obtained copolymer had a weight-average molecular weight of 64,000 and an acid value of 0.69 mmol/g.

Subsequently, 668.3 g of the copolymer solution was weighed out, 388.3 g of isopropanol and 145.7 ml of a 1 mol/L aqueous NaOH solution were added thereto, and the internal temperature of the reaction container was raised to 80° C. Then, 720.1 g of distilled water was added dropwise thereto at a rate of 20 ml/min such that the polymer was dispersed in water. Thereafter, under the atmospheric pressure, the resultant was kept for 2 hours at an internal temperature of the reaction container of 80° C., then for 2 hours at an internal temperature of the reaction container of 85° C., and for 2 hours at an internal temperature of the reaction container of 90° C. Thereafter, the internal pressure of the reaction container was reduced, and a total of 913.7 g of isopropanol, methyl ethyl ketone, and distilled water were distilled away, thereby obtaining an aqueous dispersion (emulsion) of self-dispersing resin particles (D-01) having a concentration of solid contents of 28.0%.

<Preparation of Ink>

Each of the pigment dispersions (the cyan dispersion C, the magenta dispersion M, the yellow dispersion Y, and the black dispersion K) and the self-dispersing resin particles D-01 obtained as above were mixed together such that the composition (unit: % by mass) of an ink shown in the following table 2 was obtained, thereby preparing each ink composition (a black ink composition K, a cyan ink composition C, a magenta ink composition M, and a yellow ink composition Y).

Each of the prepared ink compositions was filtered through a PVDF 5 μm filter (Millex SV manufactured by Millipore Corporation, diameter: 25 mm) by using a plastic disposable syringe, thereby obtaining finished inks (a black ink K, a cyan ink C, a magenta ink M, and a yellow ink Y).

TABLE 2

| | Magenta ink M | Black ink K | Cyan ink C | Yellow ink Y |
|---|---|---|---|---|
| Magenta dispersion M | 4 | — | — | — |
| Black dispersion K | — | 4 | — | — |
| Cyan dispersion C | — | — | 4 | — |
| Yellow dispersion Y | — | — | — | 4 |
| SANNIX GP-250 | 12 | 12 | 12 | 12 |
| Tripropylene glycol monomethyl ether | 5 | 5 | 5 | 5 |
| OLFINE E1010 | 1 | 1 | 1 | 1 |
| Aqueous dispersion of self-dispersing resin fine particles D-01 | 8 | 8 | 8 | 8 |
| Water | 70 | 70 | 70 | 70 |
| pH of ink | 8.4 | 8.5 | 8.4 | 8.4 |
| Surface tension of ink | 34.6 | 35.0 | 34.8 | 35.1 |

SANNIX GP-250: organic solvent manufactured by Sanyo Chemical Industries, Ltd.
OLEFINE E1010: noionic surfactant manufactured by Nisshin Chemical Industry Co., Ltd.

Test Example

<Evaluation of Cockle>

A GELJET GX5000 printer head manufactured by RICOH JAPAN Corp. was prepared. This printer head is a line head in which 96 nozzles are lined up. The printer head was fixed and disposed into an ink jet recording device having a structure described in FIG. 1 of JP2013-223960A.

At this time, the printer head was disposed such that the direction in which the 96 nozzles are lined up tilted by 75.7° with respect to the direction orthogonal to the movement direction of a stage of the ink jet recording device on the same plane.

In the following method, the ink droplets started to be jetted onto the aggregation-inducing layer of the recording medium on which the barrier layer and the aggregation-inducing layer were provided on the coating layer in this order.

(Droplet Jetting Method)

In a state where the recording medium was being moved at a constant speed in the movement direction of the stage, each of the black ink K, the cyan ink C, the magenta ink M and the yellow ink Y prepared as above was jetted from the printer head in a line method under the jetting conditions of an amount of ink droplet of 1.2 pL, an jetting frequency of 24 kHz, and resolution of 1200 dpi×1200 dpi (dot per inch) and a stage speed of 50 mm/s, so as to print a solid image in which dots of the respective colors were superposed on each other. More specifically, by forming a single-pass image of four colors on the central portion of the aggregation-inducing layer of the recording medium under the aforementioned conditions, a 100% solid black image (2 cm×10 cm) was printed.

Immediately after printing, the image was dried for 3 seconds at a temperature of 60° C. and then subjected to a fixing treatment at a nip pressure of 0.25 MPa and a nip width of 4 mm by being passed between a pair of fixing rollers heated to 60° C.

Thereafter, the cockling occurring immediately after printing was evaluated.

—Evaluation of Deformation of Recording Medium—

The image formed as above was visually observed, and the state of cockling occurred was evaluated according to the following evaluation standards.

A: Cockling did not occur in the entirety of the image forming portion.

B: Although cockling occurred in a portion of the image forming portion, it was at an unproblematic level for practical use.

C: Cockling occurred over a wide range of the image forming portion.

D: Cockling occurred in the entire image forming portion.

The results are shown in the following Table 3.

<Evaluation of Dot Diameter>

A GELJET GX5000 printer head (manufactured by RICOH JAPAN Corp.) was prepared, and a storage tank connected thereto was refilled with the yellow ink Y prepared as above. The printer head was fixed and disposed into the ink jet recording device having the structure described in FIG. 1 of JP2013-223960A.

Specifically, the GELJET GX5000 printer head was fixed and disposed such that the direction (main scanning direction) of the line head, in which nozzles were lined up, tilted by 75.7° with respect to the direction orthogonal to the movement direction (sub-scanning direction) of the stage. Thereafter, in a state where the recording medium provided with the barrier layer and the aggregation-inducing layer in this order as described above was being moved at a constant speed in the sub-scanning direction, the ink was jetted in a line method under the jetting conditions of an amount of ink droplets of 2.4 pL, a jetting frequency of 24 kHz, and resolution of 1,200 dpi×1,200 dpi, thereby printing yellow dots.

Immediately after printing, the image was dried for 3 seconds at a temperature of 60° C. and subjected to a fixing treatment at a nip pressure of 0.25 MPa and a nip width of 4 mm by being passed between a pair of fixing rollers heated to 60° C., thereby obtaining an evaluation sample of a dot in which dot images are formed by the yellow ink.

In the obtained evaluation sample, the diameter of twenty dots of yellow ink were measured using a microscope, and the average thereof was determined as a dot diameter. From the dot diameter, a dot diameter of yellow dots, which were formed in the same manner as described above by using the recording medium on which the barrier layer was not formed but the aggregation-inducing layer was formed on the coating layer, was subtracted. In this way, a difference of a dot diameter was calculated and evaluated according to the following evaluation standards.

—Evaluation of Dot Diameter—

A: The absolute value of the difference of a dot diameter was equal to or less than 3.0 μm.

B: The absolute value of the difference of a dot diameter was greater than 3.0 μm and equal to or less than 4.0 μm.

C: The absolute value of the difference of a dot diameter was greater than 4.0 μm and equal to or less than 5.0 μm.

D: The absolute value of the difference of a dot diameter was greater than 5.0 μm.

The results are shown in the following Table 3.

<Evaluation of Degree of Glossiness>

A GELJET GX5000 printer head (manufactured by RICOH JAPAN Corp.) was prepared, and a storage tank connected thereto was refilled with the black ink K prepared as above. The printer head was fixed and disposed into the ink jet recording device having the structure described in FIG. 1 of JP2013-223960A.

Specifically, the GELJET GX5000 printer head was fixed and disposed such that the direction (main scanning direction) of the line head, in which nozzles were lined up, tilted by 75.7° with respect to the direction orthogonal to the movement direction (sub-scanning direction) of the stage. Thereafter, in a state where the recording medium provided with the barrier layer and the aggregation-inducing in this order as described above was being moved at a constant speed in the sub-scanning direction, the ink was jetted in a line method under the jetting conditions of an amount of ink droplets of 2.4 pL, an jetting frequency of 24 kHz, and resolution of 1,200 dpi×1,200 dpi. In this way, a solid black image was printed on the entire surface of the aggregation-inducing layer.

Immediately after printing, the image was dried for 3 seconds at a temperature of 60° C. and subjected to a fixing treatment at a nip pressure of 0.25 MPa and a nip width of 4 mm by being passed between a pair of fixing rollers heated to 60° C.

By using a gloss meter IG-410 (manufactured by HORIBA, LTD.), the obtained image was evaluated in terms of a degree of glossiness at an angle of 60° specified in JIS K5600. Specifically, based on a difference in a degree of glossiness (difference of a degree of glossiness) between the image obtained as above and a solid image obtained in the same manner as described above by using a recording medium, in which the barrier layer was not formed but the aggregation-inducing layer was formed on the coating layer, the degree of glossiness was evaluated based on the following evaluation standards. Herein, in a case where a recording medium in which a barrier layer was formed was used, the degree of glossiness was the same as or higher than the degree of glossiness obtained in a case where a recording medium in which a barrier layer was not formed was used.

—Evaluation of Degree of Glossiness—

A: The difference of a degree of glossiness was less than 1.

B: The difference of a degree of glossiness was equal to or greater than 1 and less than 3.

C: The difference of a degree of glossiness was equal to or greater than 3 and less than 5.

D: The difference of a degree of glossiness was equal to or greater than 5 and less than 10.

E: The difference of a degree of glossiness was equal to or greater than 10.

TABLE 3

| | Type of acidic group-containing polymer | Amount of acidic group-containing polymer in barrier layer [g/m$^2$] | Evaluation | | |
|---|---|---|---|---|---|
| | | | Cockling | Dot diameter | Degree of glossiness |
| Example 1 | A-1 | 0.9 | B | A | B |
| Example 2 | A-1 | 0.5 | B | A | A |
| Example 3 | A-2 | 0.9 | B | A | B |
| Example 4 | A-2 | 1.8 | A | B | B |
| Example 5 | A-3 | 0.9 | A | B | B |
| Example 6 | A-4 | 0.9 | B | A | A |
| Example 7 | A-5 | 0.9 | B | A | A |
| Example 8 | A-6 | 0.9 | B | B | B |
| Example 9 | A-7 | 0.9 | A | A | A |
| Example 10 | A-8 | 0.9 | A | B | B |
| Example 11 | A-9 | 0.9 | B | B | B |
| Example 12 | A-10 | 0.9 | B | B | A |
| Example 13 | A-11 | 0.9 | A | B | A |
| Example 14 | A-12 | 0.9 | A | B | A |
| Example 15 | A-13 | 0.9 | A | B | A |
| Example 16 | A-14 | 0.9 | B | A | A |
| Example 17 | A-15 | 0.9 | A | A | B |
| Example 18 | A-16 | 0.9 | A | A | A |
| Example 19 | A-17 | 0.9 | A | A | A |
| Example 20 | A-18 | 0.9 | A | A | A |
| Example 21 | A-19 | 0.9 | A | A | A |
| Example 22 | A-20 | 0.9 | A | B | A |
| Example 23 | A-21 | 0.9 | A | A | A |
| Example 24 | A-22 | 0.9 | B | A | B |
| Example 25 | A-23 | 0.9 | B | A | B |
| Comparative Example 1 | N/A | | D | A | A |
| Comparative Example 2 | B-1 | 0.9 | B | B | C |

As is evident from the results shown in Table 3, in Comparative Example 1 not having a barrier layer, cockling occurred in the entirety of the image forming portion, and the recording medium was markedly deformed.

In Comparative Example 2 in which the polymer contained in the barrier layer did not have an acidic group, cockling is inhibited, and the change of the dot diameter was relatively small, but the degree of glossiness of the image increased.

In contrast, in all of Examples 1 to 23, the occurrence of cockling was inhibited, and the change of the dot diameter was reduced. Furthermore, a great change of the dot diameter did not occur.

What is claimed is:

1. An image recording method comprising the following steps (a) to (c):

(a) forming a barrier layer on a recording medium by using a solution which contains an acidic group-containing polymer in a nonaqueous medium;

(b) forming an organic acid-containing layer on the barrier layer; and (c) forming an image by jetting an aqueous ink onto the organic acid-containing layer by an ink jet method.

2. The image recording method according to claim 1, wherein the acidic group-containing polymer consists of a constitutional unit represented by the following Formula (1) and a constitutional unit represented by the following Formula (2), Formula (1)

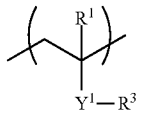

Formula (2)

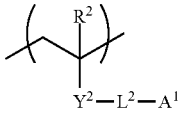

in the formulae, $R^1$ and $R^2$ represent a hydrogen atom or methyl, $Y^1$ and $Y^2$ represent —C(═O)O—, —C(═O)$NR^Y$—, or a phenylene group, $R^Y$ represents a hydrogen atom or an alkyl group, $R^3$ represents a hydrogen atom, an alkyl group, or an aromatic group, $L^2$ represents a single bond or a divalent linking group, $A^1$ is a hydrogen atom or an acidic group, and in a case where $A^1$ is a hydrogen atom, —$Y^2$-$L^2$-$A^1$ is a carboxy group.

3. The image recording method according to claim 2, wherein in the acidic group-containing polymer, a content rate of the constitutional unit represented by Formula (1) is 70% to 99% by mass, and a content rate of the constitutional unit represented by Formula (2) is 1% to 30% by mass.

4. The image recording method according to claim 1, wherein the acidic group is at least one of group selected from —COOH, —$SO_3H$, —OP(═O)$(OH)_2$, and —P(═O)$(OH)_2$.

5. The image recording method according to claim 4, wherein the acidic group is at least one of group selected from —OP(═O)$(OH)_2$, and —P(═O)$(OH)_2$.

6. The image recording method according to claim 1, wherein an acid value of the acidic group-containing polymer is equal to or less than 200 mgKOH/g.

7. The image recording method according to claim 1, wherein a weight-average molecular weight of the acidic group-containing polymer is less than 20,000.

8. The image recording method according to claim 1, wherein the organic acid is at least one selected from the group consisting of DL-malic acid, malonic acid, glutaric acid, maleic acid, and a phosphoric acid compound.

9. The image recording method according to claim 1, wherein an amount of the acidic group-containing polymer in the barrier layer is less than 10 $g/m^2$.

10. The image recording method according to claim 1, wherein the recording medium is a paper medium.

11. The image recording method according to claim 10, wherein the paper medium has a coating layer containing calcium carbonate.

12. The image recording method according to claim 1, wherein the step (c) includes fixing the image by heating.

* * * * *